US007204688B2

(12) United States Patent
Han

(10) Patent No.: US 7,204,688 B2
(45) Date of Patent: Apr. 17, 2007

(54) GAS BURNER FOR DRYER

(75) Inventor: In Hee Han, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 10/380,377

(22) PCT Filed: Jul. 19, 2002

(86) PCT No.: PCT/KR02/01360

§ 371 (c)(1),
(2), (4) Date: Mar. 14, 2003

(87) PCT Pub. No.: WO03/008862

PCT Pub. Date: Jan. 30, 2003

(65) Prior Publication Data

US 2004/0038167 A1 Feb. 26, 2004

(30) Foreign Application Priority Data

Jul. 19, 2001 (KR) ..... 10-2001-0043475
Jul. 18, 2002 (KR) ..... 10-2002-0041875
Jul. 18, 2002 (KR) ..... 10-2002-0041876
Jul. 18, 2002 (KR) ..... 10-2002-0041877
Jul. 18, 2002 (KR) ..... 10-2002-0041878
Jul. 18, 2002 (KR) ..... 10-2002-0041879

(51) Int. Cl.
*F23D 14/70* (2006.01)

(52) U.S. Cl. ..... 431/354; 431/8; 431/347; 431/349; 431/350

(58) Field of Classification Search ..... 431/10, 431/258, 263, 264, 265, 266, 354, 355, 349, 431/347, 116, 346, 8, 350; 239/500, 504, 239/498, 499, 502, 211.11–224
See application file for complete search history.

(56) References Cited

U.S. PATENT DOCUMENTS 790,714 A * 5/1905 Bray ..... 239/553.5
1,384,598 A * 7/1921 Butts ..... 431/354
1,429,857 A * 9/1922 Eyer ..... 431/350
1,933,318 A * 10/1933 Doen ..... 431/77
2,121,948 A * 6/1938 Borland ..... 431/349
2,220,603 A * 11/1940 Hirtz et al. ..... 431/350
2,558,057 A * 6/1951 Chan ..... 239/407
2,646,109 A * 7/1953 Fritz ..... 431/350

(Continued)

FOREIGN PATENT DOCUMENTS

DE 960571 * 7/1949 ..... 431/347

(Continued)

*Primary Examiner*—Carl D. Price
(74) *Attorney, Agent, or Firm*—McKenna, Long & Aldridge

(57) ABSTRACT

Gas burner for a dryer including a gas nozzle for receiving, and injecting gas, a mixing tube for mixing the gas injected from the gas nozzle and primary air, igniter fitted to an outlet of the mixing tube for igniting the gas mixed with the primary air coming out of the outlet of the mixing tube, and a flame holder fitted to the outlet of the mixing tube having flame holes for splitting, and ejecting the gas mixed with the primary air in burning the gas, thereby forming shorter flame lengths, and securing stability of the flame by enhancing an initial igniting capability, and splitting the flame into many parts to increase introduction of secondary air into the flame.

8 Claims, 19 Drawing Sheets

U.S. PATENT DOCUMENTS

| | | | | | |
|---|---|---|---|---|---|
| 2,754,895 | A | * | 7/1956 | Hershey | 431/349 |
| 2,905,235 | A | * | 9/1959 | Dolby | 431/349 |
| 2,959,216 | A | * | 11/1960 | Alger | 431/349 |
| 3,018,823 | A | * | 1/1962 | Alger | 239/500 |
| 3,124,108 | A | * | 3/1964 | Wenczl | 122/18.31 |
| 3,196,927 | A | * | 7/1965 | Alger | 239/505 |
| 3,223,141 | A | * | 12/1965 | Safford | 431/265 |
| 3,238,994 | A | * | 3/1966 | Kirk | 431/347 |
| 3,251,393 | A | * | 5/1966 | Beach et al. | 431/3 |
| 3,259,170 | A | * | 7/1966 | Koehrer | 239/416.5 |
| 3,693,887 | A | * | 9/1972 | Brodlin et al. | 239/500 |
| 3,814,077 | A | * | 6/1974 | Riehl | 126/39 E |
| 4,052,141 | A | * | 10/1977 | Dudheker et al. | 431/167 |
| 4,179,262 | A | * | 12/1979 | Wardt et al. | 431/354 |
| 4,526,535 | A | * | 7/1985 | Wunderlich | 432/105 |
| 4,701,123 | A | * | 10/1987 | Tallman et al. | 431/171 |
| 5,083,917 | A | * | 1/1992 | McCullough et al. | 432/209 |
| 5,186,620 | A | * | 2/1993 | Hollingshead | 431/354 |
| 5,433,602 | A | * | 7/1995 | Sigler | 431/286 |
| 5,992,410 | A | * | 11/1999 | Raleigh et al. | 126/110 AA |
| 6,190,163 | B1 | * | 2/2001 | Maricic et al. | 431/354 |

FOREIGN PATENT DOCUMENTS

| | | | | |
|---|---|---|---|---|
| DE | 25 47 640 | | * 4/1977 | |
| DE | 37 08 184 | | * 9/1988 | |
| DE | 4129552 | A1 | 3/1993 | |
| EP | 0672864 | A1 | 9/1995 | |
| FR | 80682 | | * 4/1963 | 431/265 |
| FR | 2624255 | | * 6/1989 | |
| GB | 934178 | | * 8/1963 | |
| GB | 1015267 | | * 12/1965 | |
| JP | 47-013956 | | 10/1973 | |
| JP | 57-052500 | | 3/1982 | |
| JP | 58-200911 | | 11/1983 | |
| JP | 59-049419 | | 3/1984 | |
| JP | 62-1258290 | | 8/1987 | |
| JP | 06-213416 | | 8/1994 | |
| JP | 08-159447 | | 6/1996 | |
| JP | 2000-249313 | | 9/2000 | |
| JP | 01-000787 | | 1/2001 | |

* cited by examiner

GAS BURNER FOR DRYER

TECHNICAL FIELD

The present invention relates to a dryer, and more particularly, to a gas burner for burning gas to produce heated air for drying objects introduced into a drum.

BACKGROUND ART

In general, the dryer dries objects, such as clothes, and the like, with air heated by electric heater, or a gas burner.

FIG. 1 illustrates a perspective disassembled view of key parts of a related art dryer. Referring to the drawing, there is a drum 1 fitted inside of a cabinet (not shown) that forms an outside shape of the dryer. The drum 1 is cylindrical, with opposite opened ends, and has a belt groove 2 along an outside circumference of a middle of the drum 1 for winding a drum belt 4 driven by a motor 3. The drum 1 has a drying chamber 5 therein for carrying out drying. The drum 1 has a plurality of lifters 6 therein for lifting and dropping drying objects in the drying chamber 5, to turn the drying objects upside down for improving a drying efficiency when the drum 1 is rotated.

The drum 1 is provided with a front supporter 7 and a rear supporter 9 fitted to a front end and a rear end thereof, oppositely. The front supporter 7 and the rear supporter 9 close opened parts of the drum 1, to form the drying chamber 5, and support the front end and the rear end of the drum 1. There are sealing members 10 fitted between the front supporter 7 and the drum 1 to be rotated, and the rear supporter 9 and the drum 1 to be rotated for prevention of leakage. Of course, there are a plurality of rollers (not shown) provided at required positions of the front supporter 7 and the rear supporter 9 of the drum 1, for supporting the drum 1.

The front supporter 7 has an opening 8 for making inside and outside of the drying chamber 5 in communication. The opening 8 is selectively opened by a door (not shown).

The rear supporter 9 is fitted with a heated air supply duct 12, in communication with the drying chamber 5, for serving as a passage for supplying heated air to the drying chamber 5.

There is an outlet assembly 13 at one side of the front supporter 7 at a bottom of the opening 8 of the front supporter 7, for escaping of air. The outlet assembly 13 is provided with a lint filter 14.

The lint filter 14 filters foreign matters (for example, lint and dust) contained in the air escaping from the drying chamber 5.

There is a lint duct 15 in communication with the outlet assembly 13, wherein the lint filter 14 is positioned even inside of the lint duct 15. There is a blower 17 connected to the lint duct 15, for drawing air from inside of the drying chamber 5 through the lint duct 15. The blower 17 is fitted to an inside of a blower housing 18 having one side in communication with the lint duct 15 and the other side connected to an air discharge pipe 19. Therefore, the air, escaped from the drying chamber 5 and passed through the lint duct 15, is discharged to an outside through the air discharge pipe 19 by the blower 17.

In the meantime, there is a guide funnel 20 connected to an inlet of the heated air supply duct 12. The guide funnel 20 guides the heated air produced by burning the gas to the inlet of the heated air supply duct. There is a mixing tube 24 at the inlet of the guide funnel 20 for mixing the gas injected from the gas nozzle 22 with primary air. The mixing tube 24 has an outlet positioned a distance inside of the guide funnel 20.

The gas nozzle 22 is fitted opposite to the inlet of the mixing tube 24, and has a valve 30 connected thereto for controlling gas supply and an amount of the gas supply. The valve 30 has a gas tube 23 connected thereto for continuous supply of gas from a gas supply source.

Accordingly, the gas injected from the gas nozzle 22 and external air introduced through the inlet of the mixing tube 24, i.e., the primary air, are mixed inside of the mixing tube 24.

The operation of the foregoing related art dryer will be explained.

Upon pressing a starting button after laundry, drying objects, is introduced into the drying chamber 5 in the drum 1, and a door thereon is closed, the drum 1 starts to rotate as the drum belt 4 wound around the belt groove 2 is driven by the motor 3. As the blower 17 starts, the air inside of the drying chamber 5 is drawn through the lint duct 15. Then, external air is introduced into the drying chamber 5 through the air supply duct 12 owing to a pressure difference.

The air to the heated air supply duct 12 is heated to a relatively high temperature by the gas burner. The gas is injected to an inside of the mixing tube 24 through the gas nozzle 22, the primary air is introduced to the inlet of the mixing tube 24, the gas and the primary air are mixed in the mixing tube 24, and ignited at the outlet of the mixing tube 24 by a spark plug 26 initially, thereby burned. A thermal energy generated as the gas is burned is introduced into the guide funnel 20, and heats the introduced air, to produce the heated air.

Meanwhile, the heated air is introduced into the drying chamber 5 in the drum 1 through the heat air supply duct 12. The heated air absorbs moist in laundry in the drying chamber 5, and escapes the drying chamber 5 through the outlet assembly 13. The air is made to escape the drying chamber 5 through the outlet assembly by a suction force of the blower 17. The foreign matters, such as dust, and lint in the air escaping through the outlet assembly 13 are filtered at the lint filter 14.

However, the foregoing related art has the following problems.

The single circular sectioned outlet of the mixing tube 24 causes to form one large and long flame as shown in FIG. 3 at the outlet of the mixing tube 24. The flame differs in size, length, and position of formation of the flame depending on a number of revolution of the blower, air resistance, and the like.

For an example, when the blower 17 has an appropriate number of revolution, though the flame 'F' is formed close to the outlet of the mixing tube 24, when the blower 17 has an excessively high number of revolution, a lifting phenomenon is occurred in which the flame 'F' is formed at a point a distance '1' away from the outlet of the mixing tube 24.

When the blower 17 runs at an excessively low number of revolutions, the flame 'F' becomes very long, such that the flame reaches to the heated air supply duct, and heats the heated air supply duct excessively, and, to the drying chamber 5 and starts fire when the flame becomes excessively long.

In other words, in the related art, if external conditions, such as the number of revolutions of the blower, and the like are not appropriate, a balance between a combustion rate of the gas and an amount of introduced air is broken, to cause lifting, or the flame to reach to an inside of the drum as the flame becomes excessively long.

Moreover, when the flame becomes longer, entire heat can not be used for heating the air, but much of the heat is taken away by adjacent components as the flame reaches close to the adjacent components, that increases heat loss.

In the related art, the initial ignition capability is poor because the gas mixed with the primary air exits the outlet of the mixing tube 24 right away.

The single circular sectioned outlet of the mixing tube 24 causes the flame 'F' to have a form of a lump, which reduces a contact area of the flame 'F' with the secondary air. That is, if the flame 'F' has the form of a lump, the contact area of the flame 'F' with the secondary air is reduced on the whole, to cause incomplete combustion as there is lack of air at an inner part of the flame, that also acts as a cause of a long flame.

Moreover, the insufficient secondary air supply to the flame 'F' causes the flame, not only to become longer, but also to turn yellowish, with incomplete combustion, to produce much soot and hazardous gases (CO, NOx, SOx).

DISCLOSURE OF INVENTION

An object of the present invention is to provide a gas burner for a dryer which can improve an ignition characteristic by improving an initial ignition capability.

Another object of the present invention is to provide a gas burner for a dryer which can improve flame characteristics such that formation of the flame is stable.

For achieving the object of the present invention, there is provided a gas burner for a dryer including a gas nozzle for receiving and spraying a gas, a mixing tube for mixing the gas sprayed from the gas nozzle and primary air, an igniter fitted to an outlet side of the mixing tube for igniting the gas mixed with the primary air passed through the outlet of the mixing tube, and a flame holder fitted to an outlet side of the mixing tube having flame holes for making the gas mixed with the primary air to be split, and sprayed in the burning.

The flame holes in the flame holder may include a central flame hole part, and a plurality of spiral flame hole parts in communication with, and around the central flame hole.

In the meantime, in another aspect of the present invention, the flame holes in the flame holder may include a central circular flame hole, and a plurality of fan shaped flame holes prolonged in a circumferential direction around the circular flame hole, in addition to the circular flame hole.

Or, in another aspect of the present invention, the flame holes in the flame holder may be circular flame holes arranged in a radial direction from a central part of a surface of the flame holder to for concentric circles.

That is, the flame holes in the flame holder may be one pass through hole in communication with others, or a plurality of pass through holes having geometrical forms the same or different from one another, and may be concentric if the geometrical forms are the same.

The flame holder may be rotatably fitted to an inside of an outlet side of the mixing tube.

In another aspect of the present invention, the flame holder includes slit forms of flame holes arranged in a radial direction in a surface of the flame holder, and a plurality of rectangular flame holes in a periphery of the flame holder along a circumferential direction thereof.

Along with this, the flame holder further includes a central circular flame hole, and a plurality of circular flame holes between the slit forms of flame holes in a radial direction at fixed intervals to be concentric with respect to the central circular flame hole. The plurality of circular flame holes between the central circular flame hole of the flame holder and the slit forms of flame holes have the same diameters, but the central circular flame hole of the flame holder and the circular flame holes in an outer part thereof may have different diameters.

The mixing tube has a structure in which a flow passage substantially becomes the smaller as it goes from an inlet side to an outlet side, and then becomes gradually the larger at a fixed ratio again, and includes an enlarged part at the outlet side of the mixing tube having the flow passage enlarged suddenly, and a flame holder fitted to an inside of the enlarged part. The enlarged part at the outlet side of the mixing tube is formed as one unit with the mixing tube, or as a detachable separate piece.

The mixing tube preferably is fitted upward at an angle with reference to a horizontal plane as it goes from an inlet side to an outlet side.

The flame holder may be rotatably fitted to an inside of an outlet of the mixing tube.

In another aspect of the present invention, the flame holder is semispherical, and includes a circular flame hole in a central part of a surface thereof, and slit forms of flame holes in a radial direction around the circular flame hole.

In this instance, the slit form of the flame hole has a form of a convex lens seen from a side, or a crescent geometrically.

Along with this, the flame holder further includes flame sustaining circular flame holes between the radial slit forms of flame holes having diameters smaller than the central flame hole.

In this instance, the flame sustaining circular flame holes between the radial slit forms of flame holes have the same diameters.

The flame sustaining circular flame holes between the radial slit forms of flame holes are positioned at ends between the slit forms of flame holes.

The mixing tube is preferably fitted upward at an angle with reference to a horizontal plane as it goes from an inlet side to an outlet side.

The flame holder may be fitted to an inside of an outlet side of the mixing tube, or so as to be located in front of the outlet of the mixing tube a distance away therefrom.

The flame holder may be rotatably fitted to an inside of the mixing tube.

In another aspect of the present invention, the flame holder includes an annular hub having a central circular flame hole, and a plurality of blades on an outer circumference of the hub along a circumferential direction thereof at fixed intervals.

The blade is twisted at an angle with respect to a hub plane.

In the meantime, the flame holder is fitted so as to be located in front of the outlet of the mixing tube as a holding part extended from one side of the hub is fixed to an outlet side of the mixing tube.

The mixing tube is preferably fitted upward at an angle with reference to a horizontal plane as it goes from an inlet side to an outlet side.

In the meantime, in another aspect of the present invention, the flame holder is of a "⌉" formed plate structure having a vertical face and a horizontal face, the vertical face having a central flame hole, and sidewall faces at both edges thereof each extended backward to rear of the flame holder to form a width.

The sidewall faces at opposite edges of the vertical face of the flame holder are formed by cutting opposite side parts of an edge where the vertical face and the horizontal face meet, and bending the opposite side parts backward.

The flame holder is fitted so as to be located in front of an outlet of the mixing tube as a holding part extended from one side of the horizontal face is fixed to an outlet side of the mixing tube.

In the meantime, in another aspect of the present invention, the flame holder includes an annular hub having a central flame hole, and a plurality of blades on an outer circumference thereof along a circumferential direction at fixed intervals.

The annular hub is convexed forward.

The blade includes a backward bent part at a fore end thereof at an angle ranging 10–30 degrees with respect to an axis direction passing through the hub.

In the meantime, the blades include at least one blade having a longer arc than the other blades formed in one side circumference of the hub.

The flame holder is fitted so as to be located in front of an outlet of the mixing tube as a holding part extended from one side of the horizontal face is fixed to an outlet side of the mixing tube.

The flame holder is rotatably fitted to an inside of an outlet of the mixing tube.

The mixing tube is fitted upward at an angle with reference to a horizontal plane as it goes from an inlet side to an outlet side.

Thus, the foregoing gas burner for a dryer of the present invention improves an initial ignition performance, shortens an entire length of a flame, facilitates introduction of more air into the flame, to form a stable blue flame having a high temperature.

BEST MODE FOR CARRYING OUT THE INVENTION

Preferred embodiments of a gas burner for a dryer of the present invention, examples of which are illustrated in the accompanying drawings, will be explained in detail in an order of embodiments, with reference to the attached drawings. Parts identical to the related art will be given the same reference symbol with the related art.

Figure 1:
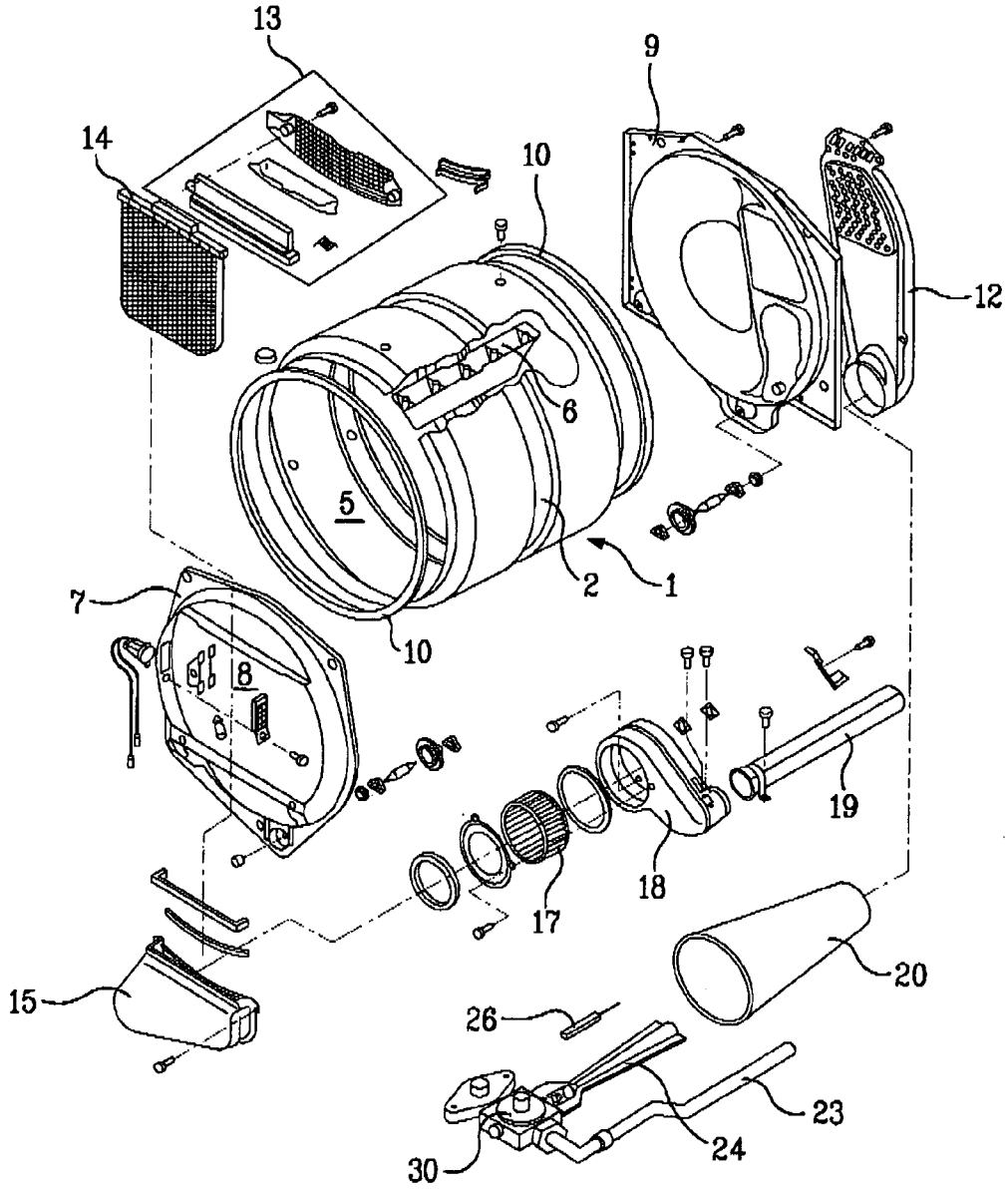
FIG.1 Prior Art
FIG. 1 illustrates a perspective disassembled view of key parts of a related art dryer.
Figure 2:
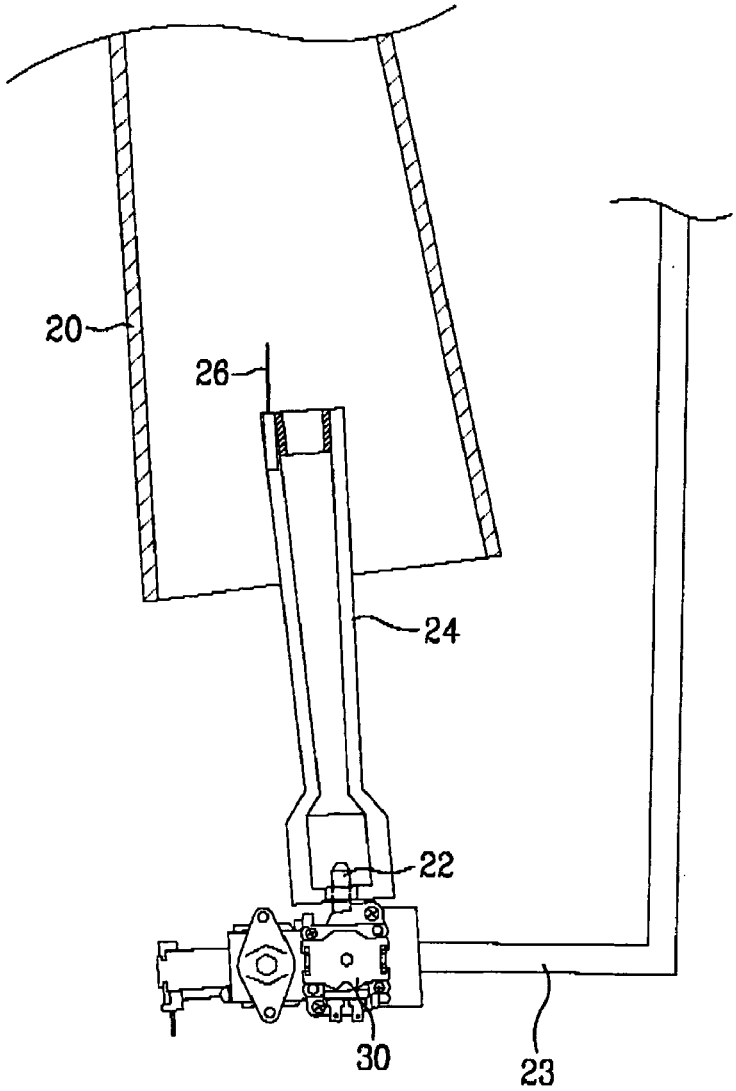
FIG. 2 Prior Art
FIG. 2 illustrates a plan view of a related art gas burner for a dryer.
Figure 3:
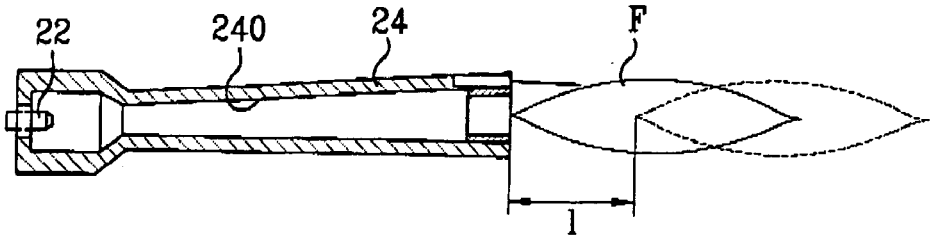
FIG. 3 Prior Art
FIG. 3 explains problems of a related art gas burner for a dryer.
Figure 4:
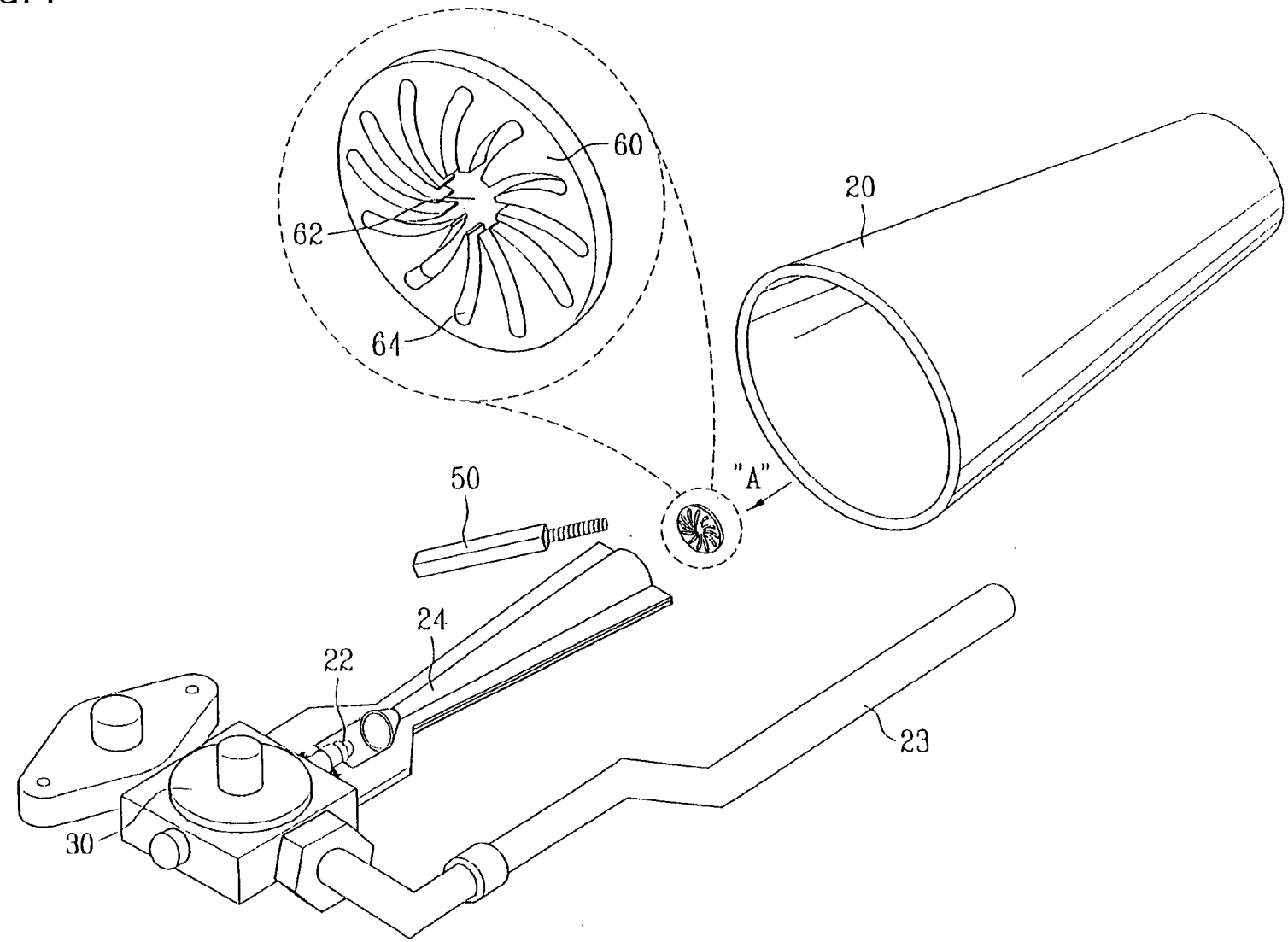
FIG. 4 illustrates a perspective disassembled view of gas burner for a dryer in accordance with a first preferred embodiment of the present invention.
Figure 5:
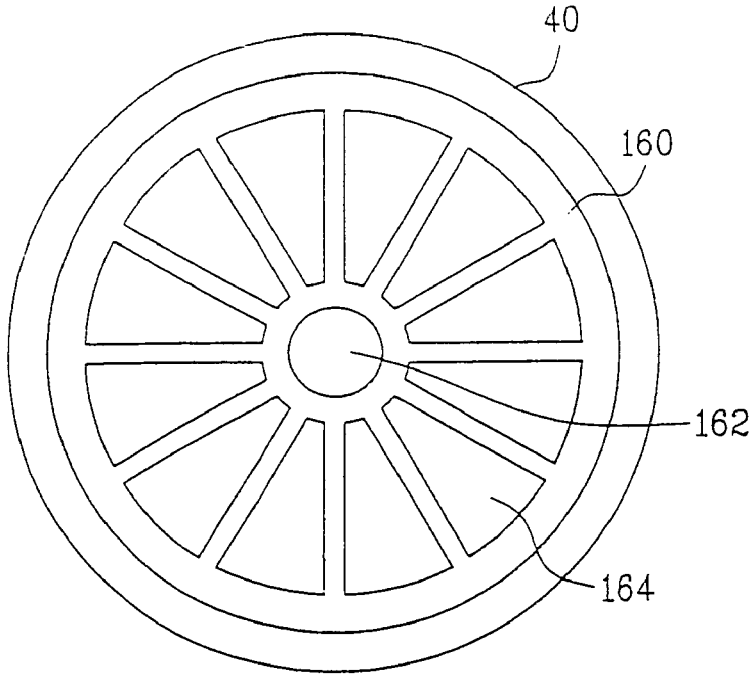
FIG. 5 illustrates one in accordance with a second preferred embodiment of the present invention, showing a front view of an outlet side of a mixer seen from 'A' direction in FIG. 4.
Figure 6:
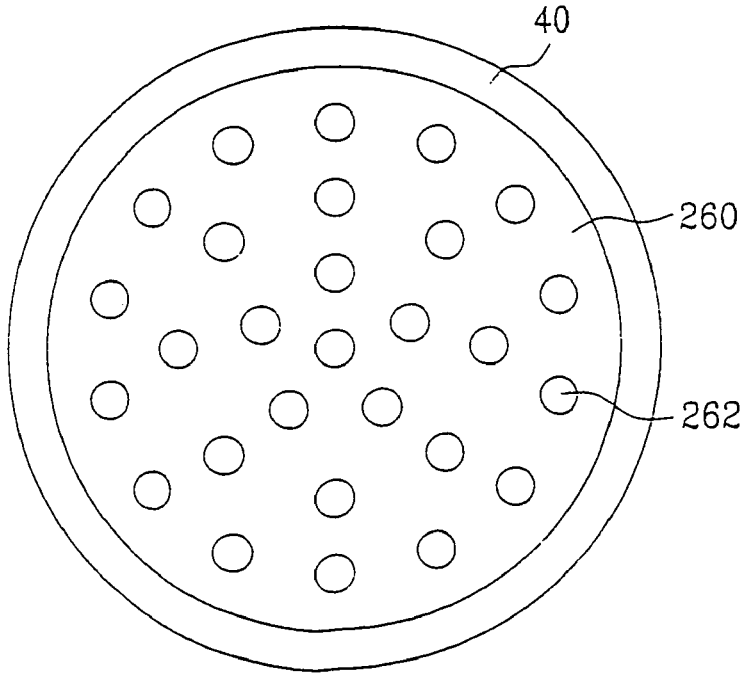
FIG. 6 illustrates a front view of an outlet side of a mixer in accordance with a third preferred embodiment of the present invention.

FIG. 4 illustrates a perspective disassembled view of gas burner for a dryer in accordance with a first preferred embodiment of the present invention, FIG. 5 illustrates one in accordance with a second preferred embodiment of the present invention, showing a front view of an outlet side of a mixer seen from 'A' direction in FIG. 4, and FIG. 6 illustrates a front view of an outlet side of a mixer in accordance with a third preferred embodiment of the present invention.

Referring to FIG. 4, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has a section designed such that a flow passage sectional area of the mixing tube 24 becomes the smaller as it goes from an inlet side to an outlet side, and then becomes gradually the larger, again. The gas sprayed from the gas nozzle 22 and the primary air enter into the inlet of the mixing tube 24.

There is an igniter 50 at an outlet side of the mixing tube 24 for igniting the gas from the mixing passage 240 of the mixing tube 24. The igniter 50 of ceramic is heated as a current is provided thereto, and ignites the gas mixed, and discharged with the primary air.

There is a flame holder 60 at an outlet side of the mixing tube 24. It is preferable that the flame holder 60 is fitted to an outlet side of the mixing tube 24 perpendicular to a flow direction of the gas. The flame holder 60 is a disk with an area the same with a sectional area of the flow passage of a fore end of the mixing tube, and has flame holes in a face thereof for spraying the gas mixed with the primary air.

The flame holder 60 has a substantially circular flame hole 62 in a central part thereof, and a plurality of spiral flame holes 64 around the circular flame hole 62 in communication therewith each having a length in a substantially radial direction. It is preferable that a ratio of areas of the circular flame hole 62 and the spiral flame holes 64 is set by an experiment.

Both the spiral flame holes 64 and the central circular flame hole 62 spray the gas mixed with the primary air received through the mixing passage 240, and form a main flame.

In the present invention, the main flame is split into a plurality of flames by the spiral flame holes 64 which are in communication, but has a form of hole split into a plurality of holes, such that the flame has a larger surface area on the whole, for receiving secondary air supply, more smoothly.

In the meantime, the mixing tube 24 is fitted upward at an angle as it goes from the inlet side to the outlet side with respect to a horizontal plane, so that a tube axis direction of the mixing tube is in agreement with a direction of flame in advance.

Next, FIG. 5 illustrates a second preferred embodiment of the present invention. The embodiment in FIG. 5 has a flame holder 160 fitted to an outlet side of the mixing passage 41 of the mixing tube 40 different from the first embodiment.

That is, the flame holder 160 has a central circular flame hole 162 with a diameter, and a plurality of fan shaped flame holes 164 around the circular flame hole 162 each with a width enlarged in a radial direction. The fan shaped flame holes 164 are separate from the circular flame hole 162.

FIG. 6 illustrates a third preferred embodiment of the present invention. In the embodiment shown in FIG. 6, the flame holder 260 fitted to a downstream of the mixing passage 41 of the mixing tube 40 has a plurality of same diametered circular flame holes 262 of forms of pass through holes for spraying gas mixed with primary air as the gas flows through the mixing passage 41. When the gas is sprayed to outside of the mixing passage 41, the plurality of circular flame holes 262 facilitate spray of the gas separate for each of the flame holes, to form flames, separately.

The flame holder 160, or 260 shown in FIG. 5, or 6 respectively may also be rotatably fitted to an inside of the outlet side of the mixing tube. That is, the flame holder 60 may be fitted so as to be kept to rotate during operation by a separate driving source (not shown) so that the gas sprayed through the flame holder 60 forms turbulence.

The operation of the foregoing first to third embodiment of the present invention will be explained, with reference to the embodiment shown in FIG. 4.

For having a drying process progressed in a dryer, it is required to elevate a temperature of air introduced into the drying chamber 5 as the gas is burned. For this, burning gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., a mixed gas) mixed with the primary air as the gas and the primary air flow along the inside passage of the mixing tube 24 is split, and sprayed through the flame holes 62 or 64 of the flame holder 60 fitted to the outlet side of the mixing tube 24. The mixed gas sprayed thus is ignited as the mixed gas receives heat from the igniter 50 provided adjacent to the flame holder 60.

Then, drying hot air is produced continuously as combustion is made as the mixed gas is kept sprayed through the flame holes in the flame holder 60 in a split state. The flame formed by the combustion of gas is split into a plurality of flames through the circular flame hole 62 and the spiral flame holes 64, (especially, the spiral flame holes).

According to this, in the present invention, a total flame length becomes short, and a contact area with the secondary air is increased.

That is, as the mixed gas discharged through the outlet side of the mixing tube 24 is split through the flame holes 62, or 64 in the flame holder 60, an entire length of the flame becomes short, and more amount of secondary air is introduced to the split short flames, with an increased mixing effect of the flames with the air, thereby achieving a perfect combustion, with blue flames in a stable flame state.

In other words, as the flame is split into a plurality of flames, an entire surface area of the flames is increased, with a relatively increased contact area with ambient air, i.e., the secondary air, the combustion of gas is made more effectively, to achieve the perfect combustion.

Moreover, the flame holder 60 divides between an inside and an outside of the mixing tube 24, to prevent a reverse direction flame, and to prevent the flame from becoming unstable by an external influence.

Thus, as the flame is shortened, and the perfect combustion is made, the present invention can prevent the lifting in which an ignition point of the flame is positioned far from an outlet of the mixing tube 24, and the overheating of the air to be supplied to the drying chamber 5 in advance.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

In the meantime, the flame holder 60 may be rotatably fitted to an inside of the outlet side of the mixing tube 24. That is, the flame holder 60 may be provided with an additional driving source (not shown) for continuous rotation during operation, so that the gas sprayed through the flame holder 360 forms a turbulence.

A gas burner for a dryer in accordance with a fourth preferred embodiment of the present invention will be explained in detail, with reference to the attached drawings. Parts identical to the related art will given the same reference symbols in the explanation.

Figure 7:
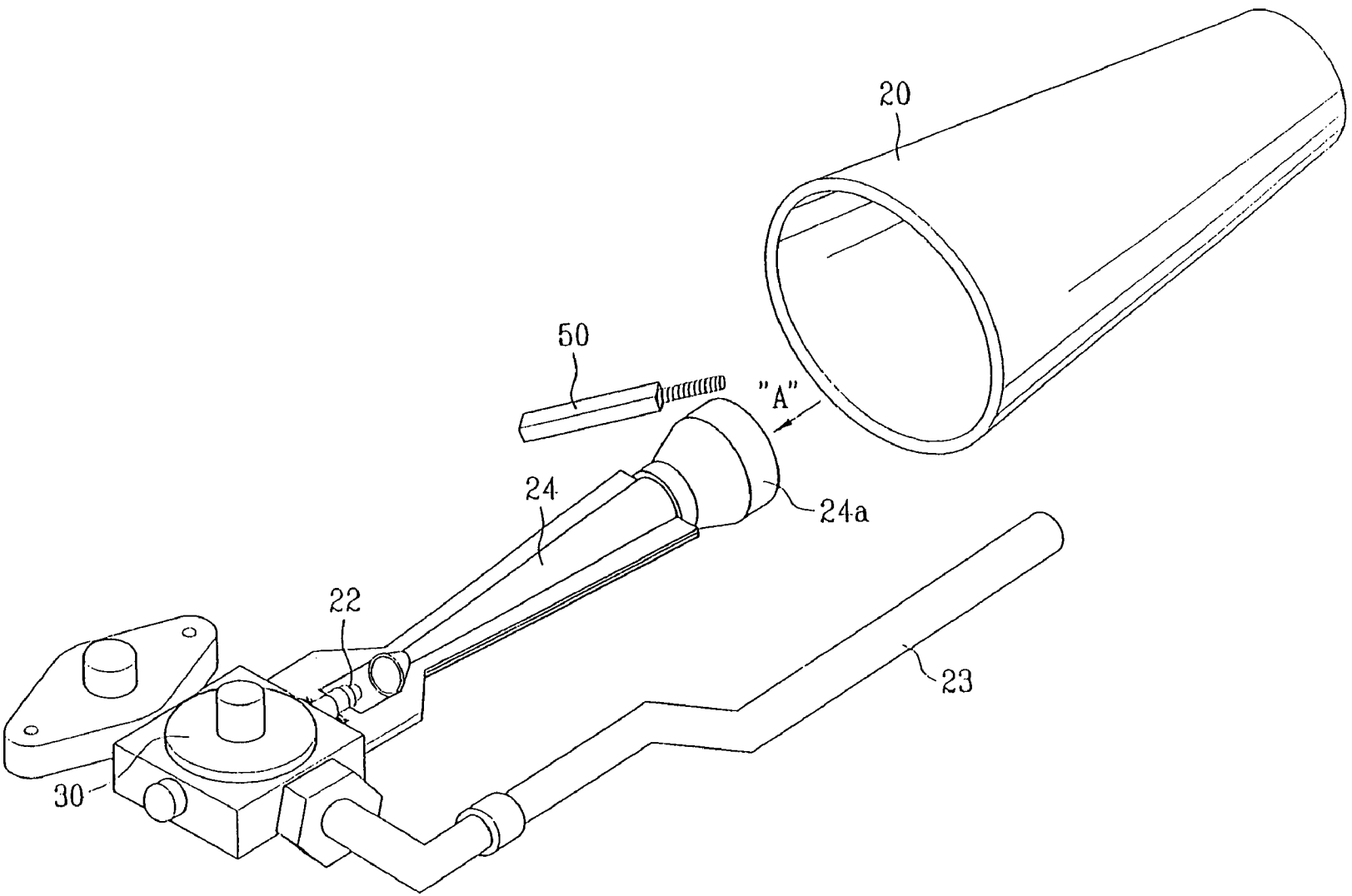
FIG. 7 illustrates a perspective disassembled view of gas burner for a dryer in accordance with a fourth preferred embodiment of the present invention.
Figure 8:
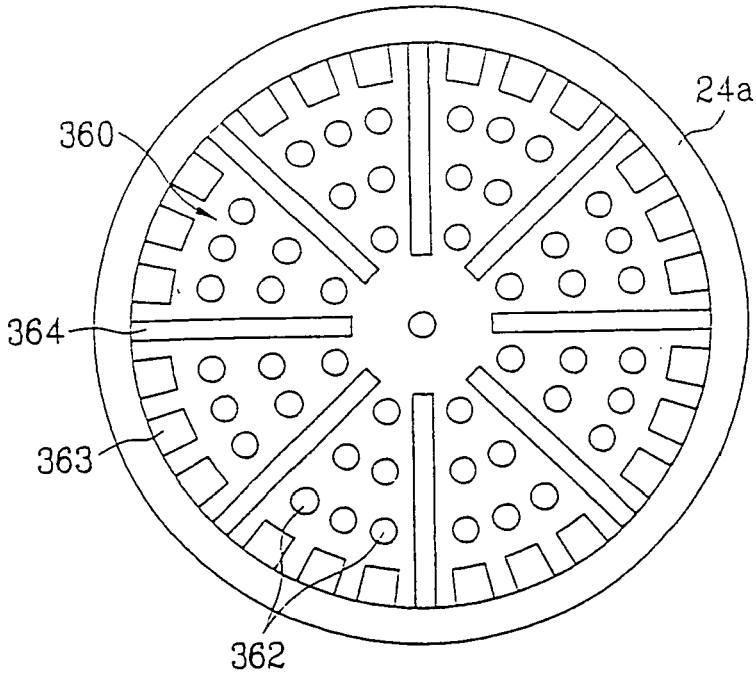
FIG. 8 illustrates a front view of an outlet side of a mixer seen from 'A' direction in FIG. 7.
Figure 9:
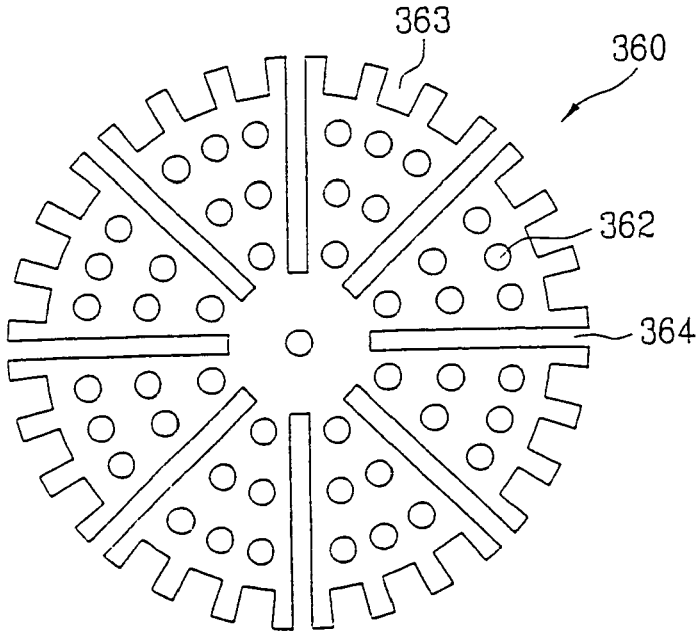
FIG. 9 illustrates a front view only of the flame holder in FIG. 8.

FIG. 7 illustrates a perspective disassembled view of gas burner for a dryer in accordance with a fourth preferred embodiment of the present invention, FIG. 8 illustrates a front view of an outlet side of a mixer seen from 'A' direction in FIG. 7, and FIG. 9 illustrates a front view only of the flame holder in FIG. 8.

Referring to FIGS. 7–9, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has section designed such that a flow passage sectional area of the mixing tube 24 becomes the smaller as it goes from an inlet side to an outlet side, and then becomes gradually the larger, again. The gas sprayed from the gas nozzle 22 and the primary air enter into the inlet of the mixing tube 24.

There is an igniter 50 at an outlet side of the mixing tube 24 for igniting the gas from the mixing passage 240 of the mixing tube 24. The igniter 50 of ceramic is heated as a current is provided thereto, and ignites the gas mixed, and discharged with the primary air. The igniter 50 is either fitted to the mixing tube 24, or supported separately.

There is a flame holder 360 at an outlet side of the mixing tube 24. It is preferable that the flame holder 360 is fitted to an outlet side of the mixing tube 24 perpendicular to a flow direction of the gas. The flame holder 360 is a disk with an area the same with a sectional area of an enlarged part 24*a* of the flow passage at a fore end of the mixing tube, and has a variety of forms of flame holes in a face thereof for spraying the gas mixed with the primary air.

That is, the flame holder 360 has a plurality of slit form of flame holes 364 in a face thereof in a radial direction thereof, and a plurality of rectangular form of flame holes in a periphery thereof along a circumference.

It is preferable that the flame holder 360 has a circular flame hole 362 in a central part thereof, and a plurality of circular flame holes 362 spaced fixed distances in a radial direction concentric to the circular flame hole 362 in the central part of the face between the slit form of flame holes 364 formed in a radial direction. The circular flame hole 362 is pass through hole with a fix diameter.

The circular flame holes 362 between the slit form of flame holes 364 have the same diameters, but the flame hole in the central part of the face of the flame holder 360 may have a diameter different from the flame holes in an outer part thereof.

It is preferable that ratios of areas of the circular flame holes 362, the slit form of flame hole 364, and the rectangular flame holes 363 are set by an experiment.

The circular flame holes 362, the slit form of flame hole 364, and the rectangular flame holes 363 spray the gas mixed with the primary air received through the mixing passage 240, and form a main flame.

In the present invention, owing to the enlarged part 24*a* having a flow passage enlarged suddenly at the outlet side of the mixing tube 24, and the flame holder 360 having a plurality of flame holes on an inner side thereof, an initial ignition capability is enhanced since a speed of gas escaping from the flame holes in the flame holder 360 can be maintained to an appropriate level.

Moreover, in the present invention, as the main flame is split into a plurality of flames by the plurality of slit form of flame holes 364 and circular flame holes 363, with an increased surface area of the flame on the whole, supply of the secondary air becomes more smooth. Especially, the concentric circular flame holes 362 serves to sustain the main flame.

In the meantime, the mixing tube 24 is fitted tilted upward at an angle as it goes from the inlet side to the outlet side, so that a tube axis direction of the mixing tube is in agreement with a direction of flame in advance.

The fourth embodiment of the present invention will be explained, with reference to the embodiment shown in FIGS. 7–9.

For having a drying process progressed in a dryer, it is required to elevate a temperature of air introduced into the drying chamber 5 as the gas is burned. For this, burning gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., a mixed gas) mixed with the primary air as the gas and the primary air flow along the inside passage of the mixing tube 24 is split, and sprayed through the flame holes 362, 363, or 364 of the flame holder 360 fitted to the outlet side of the mixing tube 24. The mixed gas sprayed thus is ignited as the mixed gas receives heat from the igniter 50 provided adjacent to the flame holder 360.

Then, drying hot air is produced continuously as combustion is made, as the mixed gas is kept sprayed through the flame holes in the flame holder 360 in a split state. In this instance, the flame formed by the combustion of gas is split into a plurality of flames by the slit form of flame holes 364, the rectangular flame holes 363, and the concentric flame holes 362.

According to this, in the present invention, a total flame length becomes shorter, and a contact area with the secondary air becomes larger.

That is, as the mixed gas discharged through the outlet side of the mixing tube 24 is split through the flame holes 362, 363, or 364 in the flame holder 360, an entire length of the flame becomes shorter, and more amount of secondary air is introduced to the split short flames, with an increased mixing effect of the flames with the air that enhances combustion, thereby achieving a perfect combustion, with blue flames in a stable flame state.

In other words, as the flame is split into a plurality of flames, an entire surface area of the flames is increased, with a relatively increased contact area with ambient air, i.e., the secondary air, the combustion of gas is made more effectively, to achieve the perfect combustion.

Moreover, the flame holder 360 divides between an inside and an outside of the mixing tube 24, to prevent a reverse direction flame, and to prevent the flame from becoming unstable by an external influence.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

In the meantime, the flame holder 360 may be rotatably fitted to an inside of the enlarged part 24*a* of the outlet side of the mixing tube 24. That is, the flame holder 360 may be provided with an additional driving source (not shown) for continuous rotation during operation, so that the gas sprayed through the flame holder 360 forms turbulence.

A gas burner for a dryer in accordance with a fifth preferred embodiment of the present invention will be explained, with reference to the attached drawings. Alikely, parts identical to the related art will be given the same reference symbols.

Figure 10:
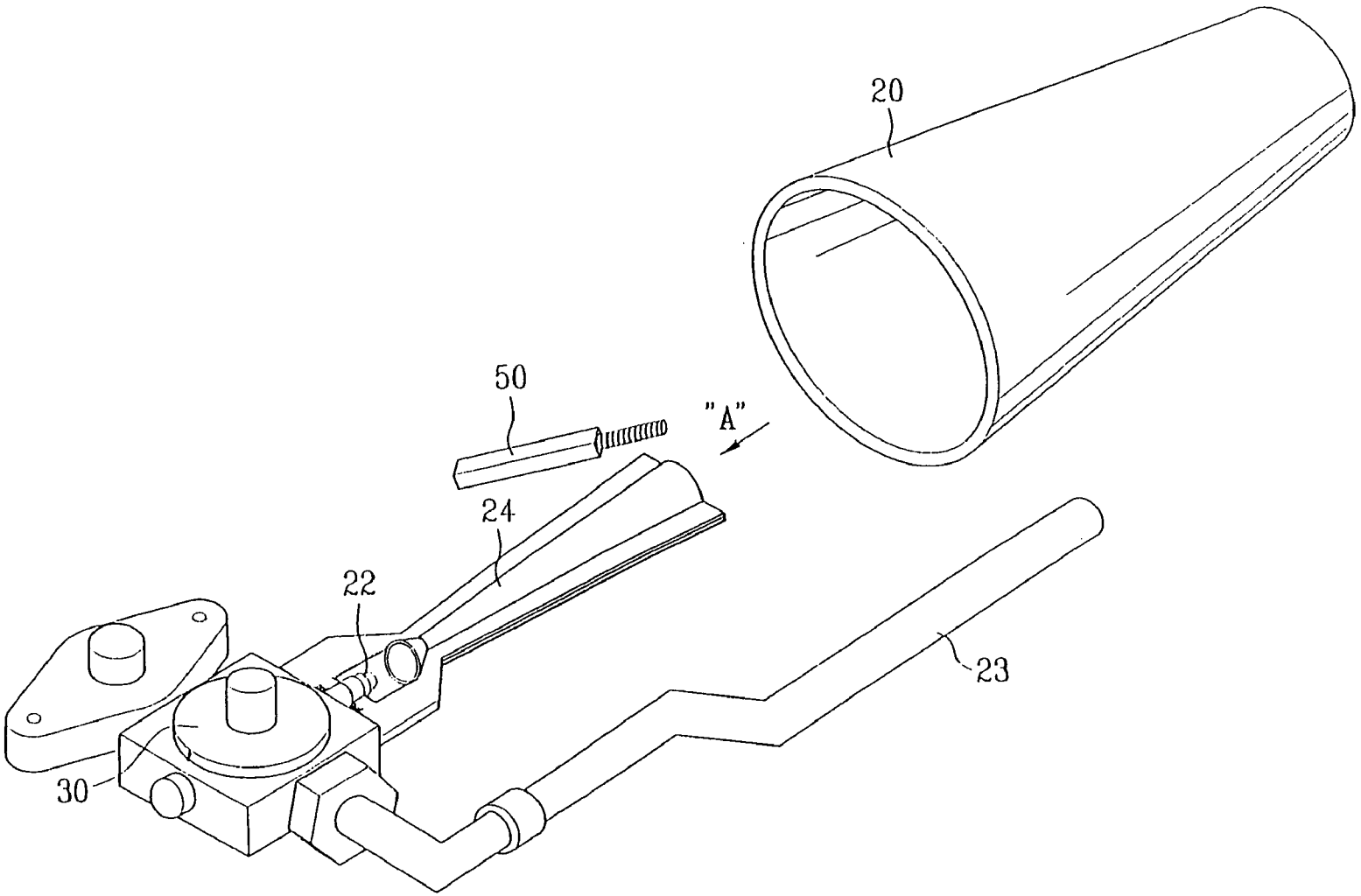
FIG. 10 illustrates a perspective disassembled view of gas burner for a dryer in accordance with a fifth preferred embodiment of the present invention.
Figure 11A:
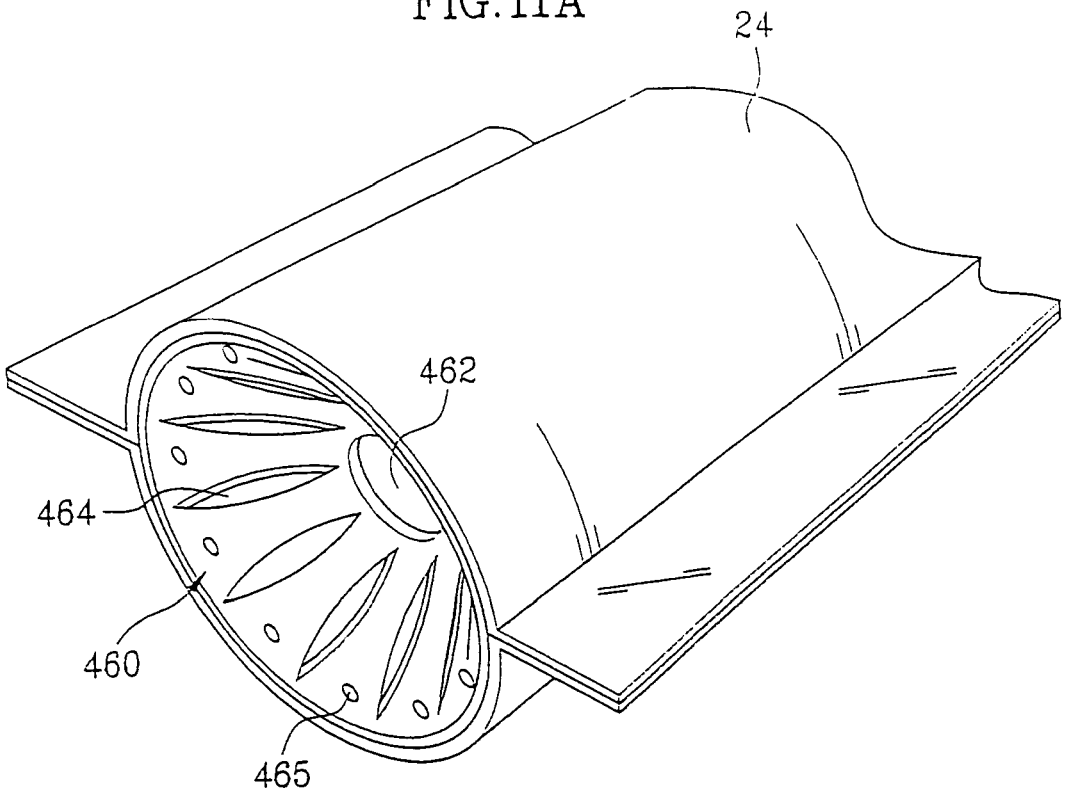
FIG. 11A illustrates a perspective view of an outlet side of a mixing tube seen from 'A' direction in FIG. 10.
Figure 11B:
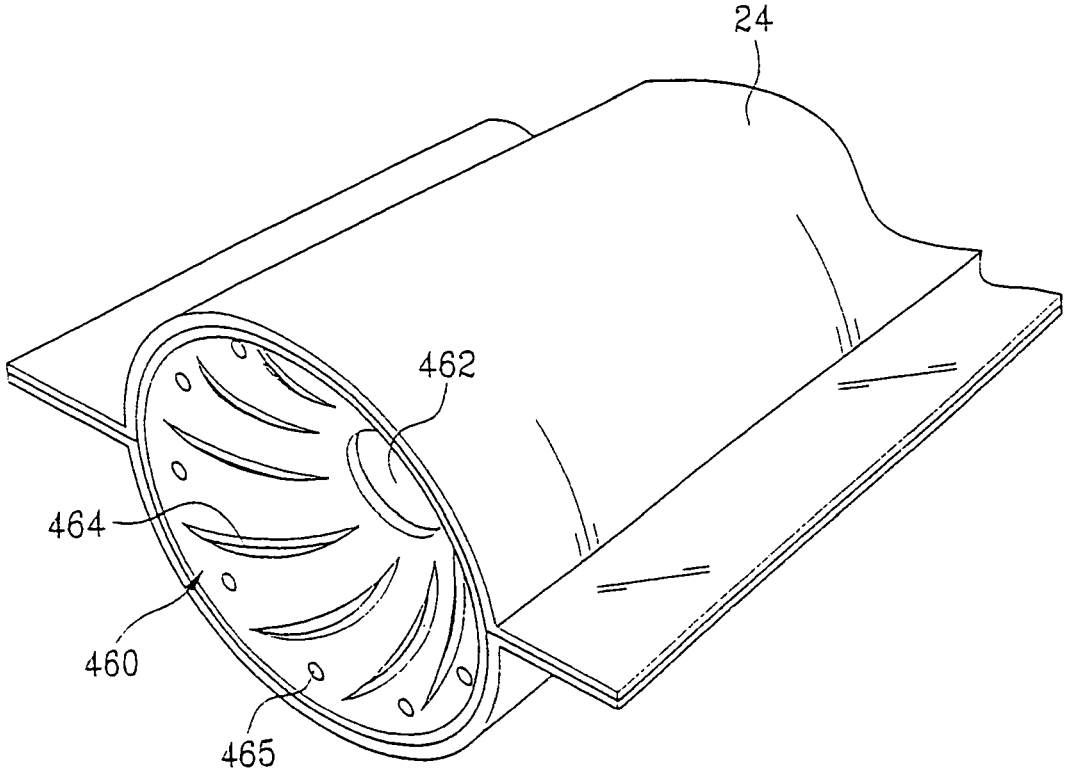
FIG 11B illustrates a perspective view of an outlet side of a mixing tube seen from 'A' direction in FIG. 10, showing another embodiment of the flame holder.

FIG. 10 illustrates a perspective disassembled view of gas burner for a dryer in accordance with a fifth preferred embodiment of the present invention, FIG. 11A illustrates a perspective view of key parts of an outlet side of a mixing tube seen from 'A' direction in FIG 10, and FIG. 11B illustrates a perspective view of an outlet side of a mixing tube seen from 'A' direction in FIG. 10, showing another embodiment of the flame holder.

As shown, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has section designed such that a flow passage sectional area of the mixing tube 24 becomes the smaller as it goes from an inlet side to an outlet side, and then becomes gradually the larger, again. The gas sprayed from the gas nozzle 22 enters into the inlet of the mixing tube 24, together with the primary air.

There is an igniter 50 at an outlet side of the mixing tube 24 for igniting the gas from the mixing passage 240 of the mixing tube 24. The igniter 50 of ceramic is heated as a current is provided thereto, and ignites the gas mixed, and discharged with the primary air. The igniter 50 is either fitted to the mixing tube 24, or supported, separately.

There is a semispherical flame holder 460 at an outlet side of the mixing tube 24 having a variety of forms of flame holes 462, 464, and 465 in a face thereof for spraying the gas mixed with the primary air. The flame holder 460 is fitted so as to be recessed toward the inlet of the mixing tube 24, and has a circular flame hole 462 in a central part of the spherical surface, a plurality of slit form of flame holes 464 around the circular flame hole in a radial direction, and circular flame holes 465 between the slit form of flame holes 464 for sustaining the flame.

In the meantime, the slit form of the flame hole may have a form of a convex lens seen from a side as shown in FIG. 11A, or a crescent as shown in FIG 11B.

It is preferable that ratios of areas of the circular flame hole 462 in the central part of the spherical surface, the slit form of flame holes 464, and the circular flame holes 465 for sustaining a flame are set by an experiment.

The circular flame hole 462 in the central part of the spherical surface, the slit form of flame holes 464, and the circular flame holes 462 for sustaining the flame spray the gas mixed with the primary air received through the mixing passage 240, to form a flame, of which main flame is formed by the slit form of flame holes 464 and the circular flame hole 462 in the central part of the spherical surface during combustion.

In the present invention, owing to the semispherical form of the flame holder 460 recessed toward the inlet side of the mixing tube 24, an initial ignition capability is enhanced since the gas escaped from the different flame holes in the flame holder 460 gather at a center part of the outlet of the mixing tube 24 to a certain extent, that increases an amount of the mixed gas staying around the igniter 50, and reduces a flow speed of the gas.

Moreover, in the present invention, as the main flame is split into a plurality of flames by the plurality of slit form of flame holes 464 and the circular flame hole 462 in the central part of the spherical surface, with an increased surface area of the flame on the whole, supply of the secondary air becomes more smooth. Especially, the circular flame holes 465 between the slit forms of flame holes 464 serve to sustain the main flame.

In the meantime, the mixing tube 24 is fitted tilted upward at an angle with reference to a horizontal plane as it goes from the inlet side to the outlet side, so that a tube axis direction of the mixing tube is in agreement with a direction of flame in advance.

The operation of the foregoing fifth embodiment of the present invention will be explained, with reference to the embodiments shown in FIGS. 10, and 11A–11B.

For having a drying process progressed in a dryer, it is required to elevate a temperature of air introduced into the drying chamber 5 as the gas is burned. For this, gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., a mixed gas) mixed with the primary air as the gas and the primary air flow along the inside passage of the mixing tube 24 is split, and sprayed through the flame holes 462, 464, or 465 of the semispherical flame holder 460 fitted to the outlet side of the mixing tube 24 so as to be recessed toward the inlet side. The mixed gas sprayed thus is ignited as the mixed gas receives heat from the igniter 50 provided adjacent to the flame holder 460.

Then, drying hot air is produced continuously as combustion is made, as the mixed gas is kept sprayed through the flame holes 462, 464, and 465 in the flame holder 460 in a split state. In this instance, the flame formed by the combustion of gas is split into a plurality of flames by the slit form of flame holes 464, the circular flame hole 462 in a central part of a spherical surface, and the circular flame holes 465 between the slit form of flame holes 464.

According to this, in the present invention, a total flame length becomes shorter, and a contact area with the secondary air becomes larger.

That is, as the mixed gas discharged through the outlet side of the mixing tube 24 is split through the flame holes 462, 463, and 464 in the flame holder 460, an entire length of the flame becomes shorter, and more amount of secondary air is introduced to the split short flames, with an increased mixing effect of the flames with the air, thereby achieving a perfect combustion, with blue flames in a stable flame state.

In other words, as the flame is split into a plurality of flames, an entire surface area of the flames is increased, with a relatively increased contact area with ambient air, i.e., the secondary air, the combustion of gas is made more effectively, to achieve the perfect combustion.

Moreover, the flame holder 460 divides between an inside and an outside of the mixing tube 24, to prevent a reverse direction flame, and to prevent the flame from becoming unstable by an external influence.

Thus, as the flame is shortened, and the combustion is made effectively to achieve perfect combustion, the present invention can prevent the lifting in which an ignition point of the flame is positioned far from an outlet of the mixing tube 24, and the overheating of the air to be supplied to the drying chamber 5 in advance.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

Figure 12:
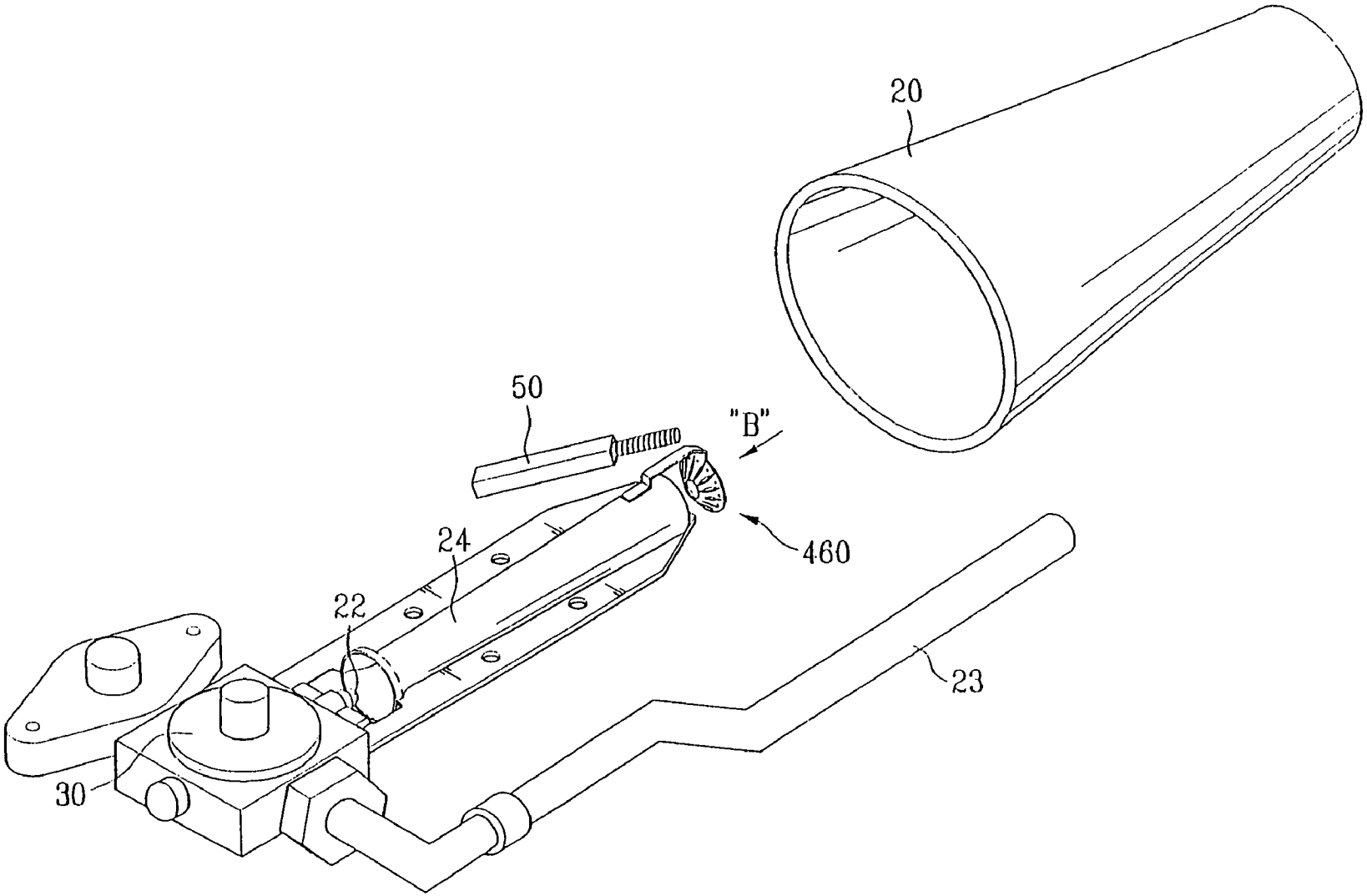
FIG. 12 illustrates a perspective disassembled view of gas burner for a dryer in accordance with a sixth preferred embodiment of the present invention.

In the meantime, FIG. 12 illustrates a perspective disassembled view of gas burner for a dryer in accordance with a sixth preferred embodiment of the present invention, wherein it can be noted that this is a case a fitting position of the semispherical flame holder 460 explained in the foregoing embodiment is changed.

That is, different from the foregoing embodiment, the semispherical flame holder 460 is positioned in front of the outlet of the mixing tube 24 by a holding part 466.

Figure 13A:
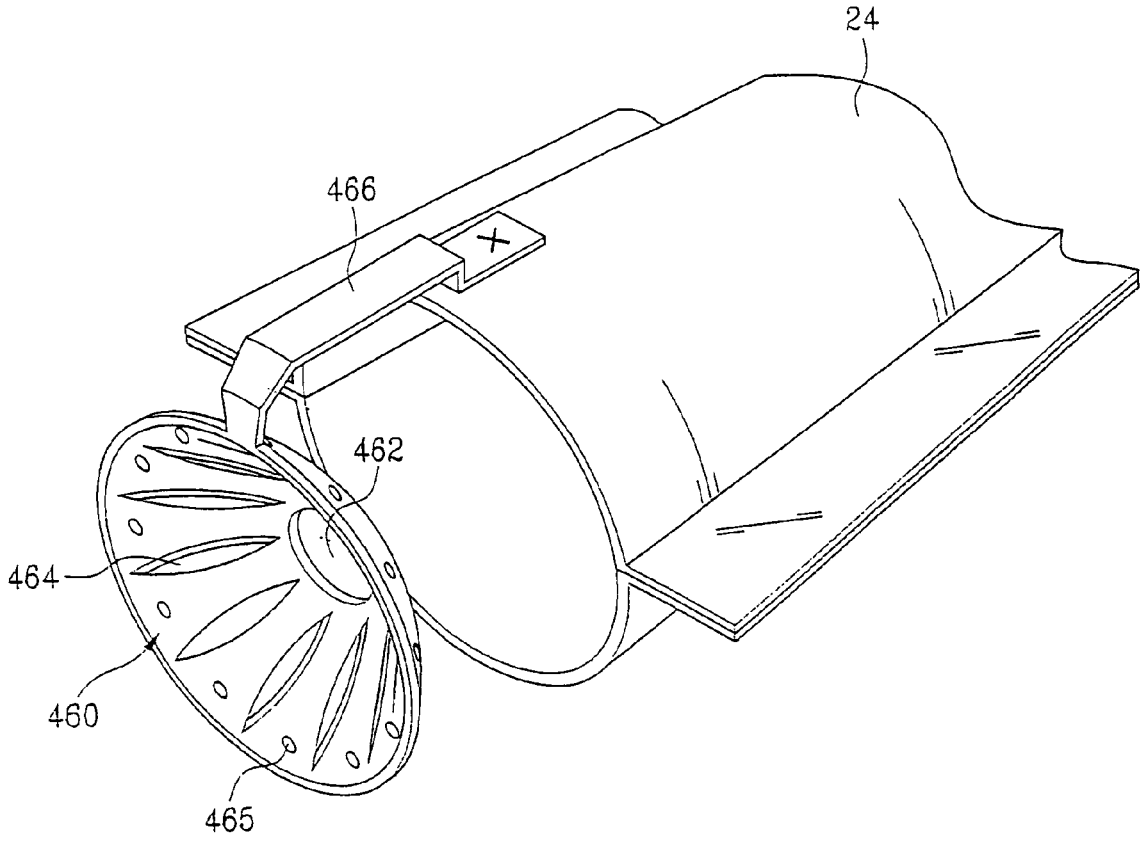
FIG. 13A illustrates a perspective view of an outlet side of a mixing tube seen from 'B' direction in FIG. 12.

In the meantime, FIG. 13A illustrates a perspective view of an outlet side of a mixing tube seen from 'B' direction in FIG. 12, wherein forms and positions of the flame holes in the spherical surface of the flame holder 460 are identical to the case of FIG. 11A, of which explanation will be omitted, accordingly.

Figure 13B:
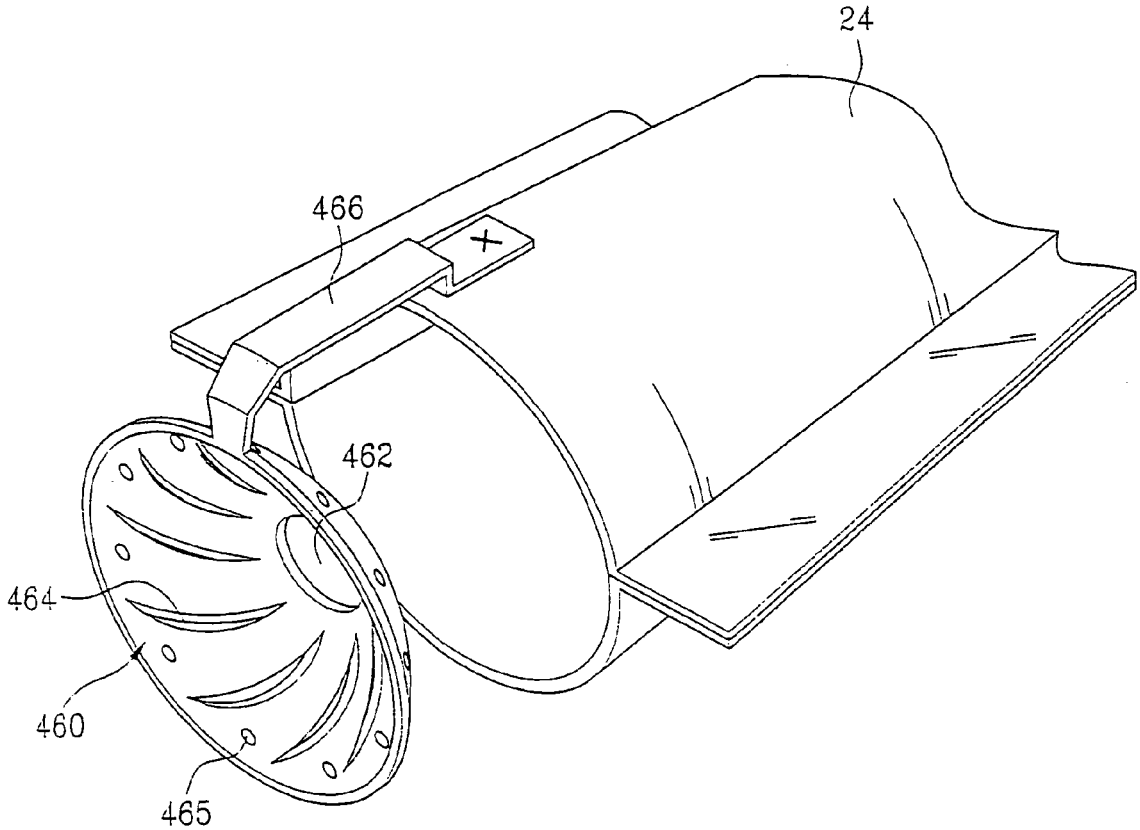
FIG. 13B illustrates a perspective view of an outlet side of a mixing tube seen from 'B' direction in FIG. 12, showing another embodiment of the flame holder.

FIG. 13B illustrates a perspective view of an outlet side of a mixing tube seen from 'B' direction in FIG. 12, showing another embodiment of the flame holder, wherein forms and positions of the flame holes in the spherical surface of the flame holder 460 are identical to the case of FIG. 11B, of which explanation will be omitted too, accordingly.

Meanwhile, the flame holder 460 may be rotatably fitted to an inside of the outlet side of the mixing tube 460. That is, the flame holder 460 may be fitted so as to be kept to rotate during operation by a separate driving source (not shown) so that the gas sprayed through the flame holder 460 forms turbulence.

A gas burner for a dryer in accordance with a seventh preferred embodiment of the present invention will be explained, with reference to the attached drawings. Alikely, parts identical to the related art will be given the same reference symbols.

Figure 14:
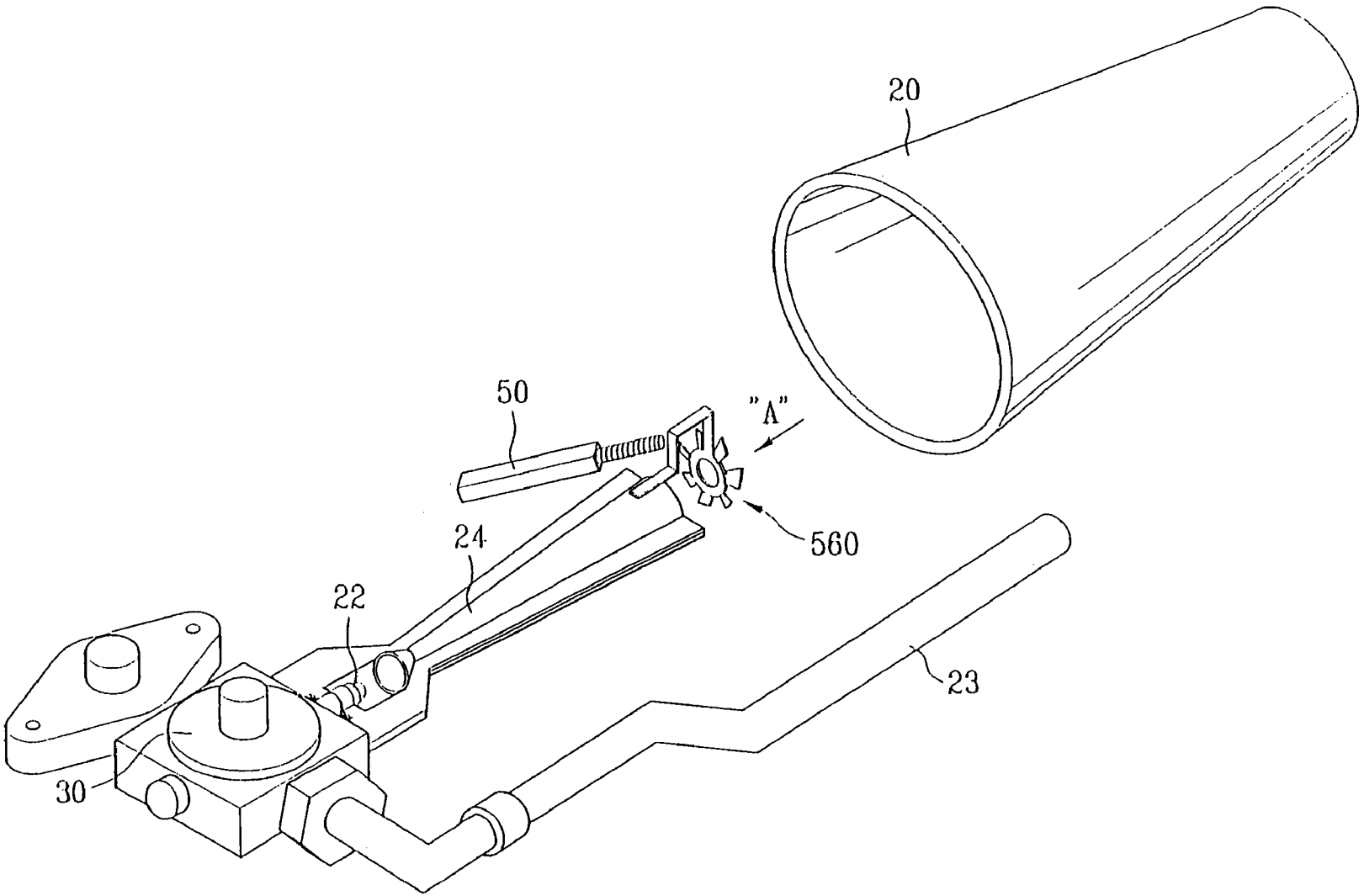
FIG. 14 illustrates a perspective disassembled view of gas burner for a dryer in accordance with a seventh preferred embodiment of the present invention.
Figure 15:
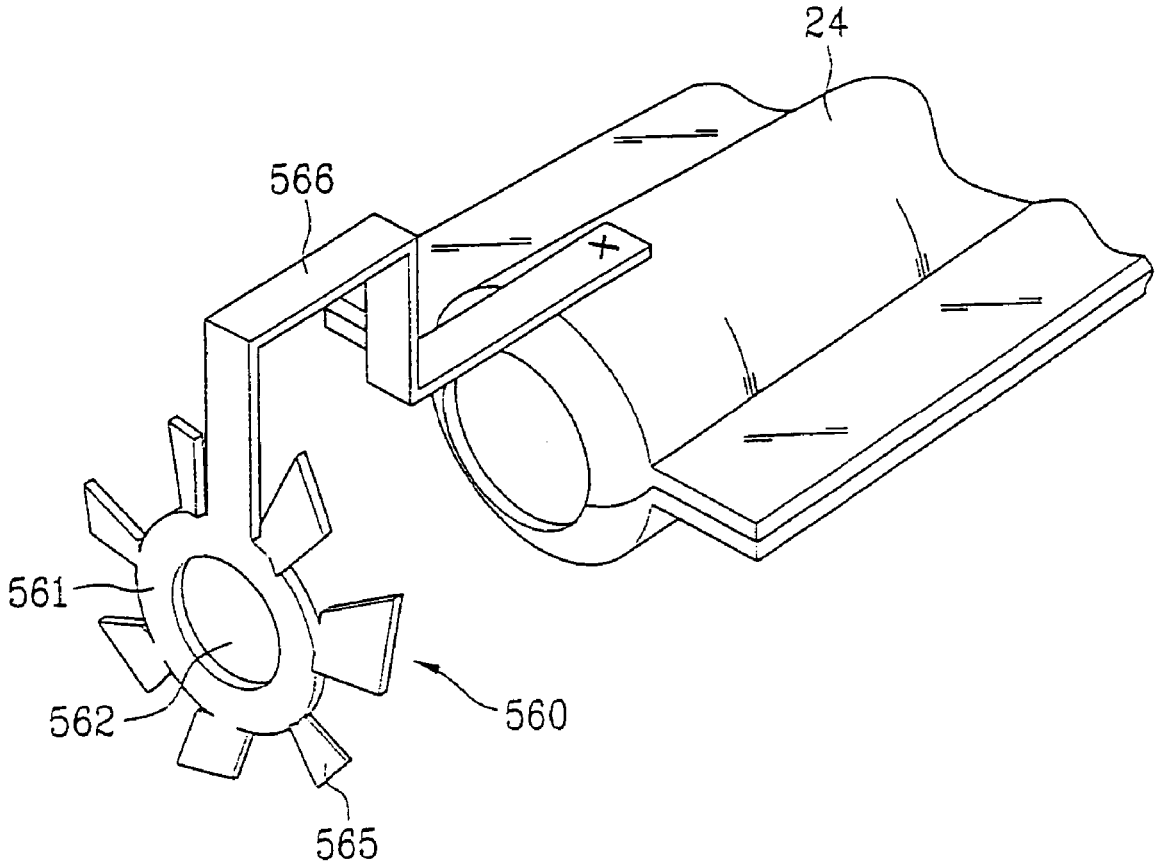
FIG. 15 illustrates a perspective view of an outlet side of a mixer seen from 'A' direction in FIG. 14.

FIG. 14 illustrates a perspective disassembled view of gas burner for a dryer in accordance with a seventh preferred embodiment of the present invention, and FIG. 15 illustrates a perspective view of an outlet side of a mixer seen from 'A' direction in FIG. 14.

Referring to FIGS. 14 and 15, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has section designed such that a flow passage sectional area of the mixing tube 24 becomes the smaller as it goes from an inlet side to an outlet side, and then becomes gradually the larger, again. The gas sprayed from the gas nozzle 22 enters into the inlet of the mixing tube 24, together with the primary air.

There is an igniter 50 at an outlet side of the mixing tube 24 for igniting the gas from the mixing passage 240 of the mixing tube 24. The igniter 50 of ceramic is heated as a current is provided thereto, and ignites the gas mixed, and discharged with the primary air. The igniter 50 is either fitted to the mixing tube 24, or supported, separately.

There is a flame holder 560 in front of an outlet side of the mixing tube 24. The flame holder 560 has an annular hub 561 with a central circular flame hole 562, and blades 565 fitted at fixed intervals on an outer circumference of the hub 561 along a circumferential direction for splitting the flame.

In this instance, the blades 565 are formed to have an angle twisted with respect to a plane of the hub 561 for circulating the flames once split as the gas passes between the blades.

The flame holder 560 can be positioned in front of the outlet of the mixing tube as the holding part 566 extended from one side of the hub 561 is fixed to the outlet side of the mixing tube.

It is preferable that a diameter of the circular flame hole 562, and a width of the blade 565 are set by an experiment.

In the present invention, the flame holder 560 serves the gas, mixed with the primary air as the gas passes through the mixing flow passage 240, to be sprayed and burned, wherein a main flame is formed by the mixed gas (gas mixed with the primary air) sprayed through the circular flame hole 562 in the central part of the hub 561 and openings between the blades 565.

In this instance, in the present invention, an initial ignition capability is enhanced since an amount of the gas momentarily staying behind the flame holder 560 before passing through the flame holder 560 is increased while a speed of the gas is dropped by the holding part 566 extended from the hub 561 of the flame holder 560.

Moreover, in the present invention, as the main flame is split into a plurality of flames by the circular flame hole 562 in the central part of the flame holder and the plurality of the blades 565, with an increased surface area of the flame on the whole, supply of the secondary air becomes more smooth.

Especially, the twisting of blades 565 with respect to a hub 561 plane at a fixed angle provides a circulating force to the flame once split by combustion of the gas passing through the blades, that makes the combustion more effective.

In the meantime, the mixing tube 24 is fitted tilted upward at an angle as it goes from the inlet side to the outlet side, so that a tube axis direction of the mixing tube is in agreement with a direction of flame, naturally.

The operation of the foregoing seventh embodiment of the present invention will be explained, with reference to FIGS. 14, and 15.

For having a drying process progressed in a dryer, it is required to elevate a temperature of air introduced into the drying chamber 5 as the gas is burned. For this, gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., a mixed gas) mixed with the primary air as the gas and the primary air flow along the inside passage of the mixing tube 24 is split, and sprayed through the circular flame hole 562, and openings between the blades 565 of the flame holder 560 provided on the outlet side of the mixing tube 24. The mixed gas sprayed thus is ignited as the mixed gas receives heat from the igniter 50 provided adjacent to the flame holder 560.

Then, drying hot air is produced continuously as combustion is made, as the mixed gas is kept sprayed through the circular flame hole 562, and the blades 565 of the flame holder 560 in a split state.

According to this, in the present invention, a total flame length becomes shorter, and a contact area of the flame with the secondary air becomes larger.

That is, as the mixed gas discharged through the outlet side of the mixing tube 24 is split through the circular flame hole 562, and the blades 565 of the flame holder 560, an entire length of the flame becomes shorter, and more amount of secondary air is introduced to the split short flames, with an increased mixing effect of the flames with the air to enhance combustion, thereby achieving a perfect combustion, with blue flames in a stable flame state.

In other words, as the flame is split into a plurality of flames, an entire surface area of the flames is increased, with a relatively increased contact area with ambient air, i.e., the secondary air, the combustion of gas is made more effectively, to achieve the perfect combustion.

Moreover, the flame holder 560 divides between an inside and an outside of the mixing tube 24, to prevent a reverse direction flame, and to prevent the flame from becoming unstable by an external influence.

Thus, as the flame is shortened, and the combustion is made effectively to achieve perfect combustion, the present invention can prevent the lifting in which an ignition point of the flame is positioned far from an outlet of the mixing tube 24, and the overheating of the air to be supplied to the drying chamber 5 in advance.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

In the meantime, the flame holder 560 may be rotatably fitted to an inside of the outlet side of the mixing tube. That is, the flame holder 560 may be fitted so as to be kept to rotate during operation by a separate driving source (not shown) so that the gas sprayed through the flame holder 560 forms turbulence.

Next, a gas burner for a dryer in accordance with an eighth preferred embodiment of the present invention will be explained, with reference to the attached drawings. Alikely, parts identical to the related art will be given the same reference symbols.

Figure 16:
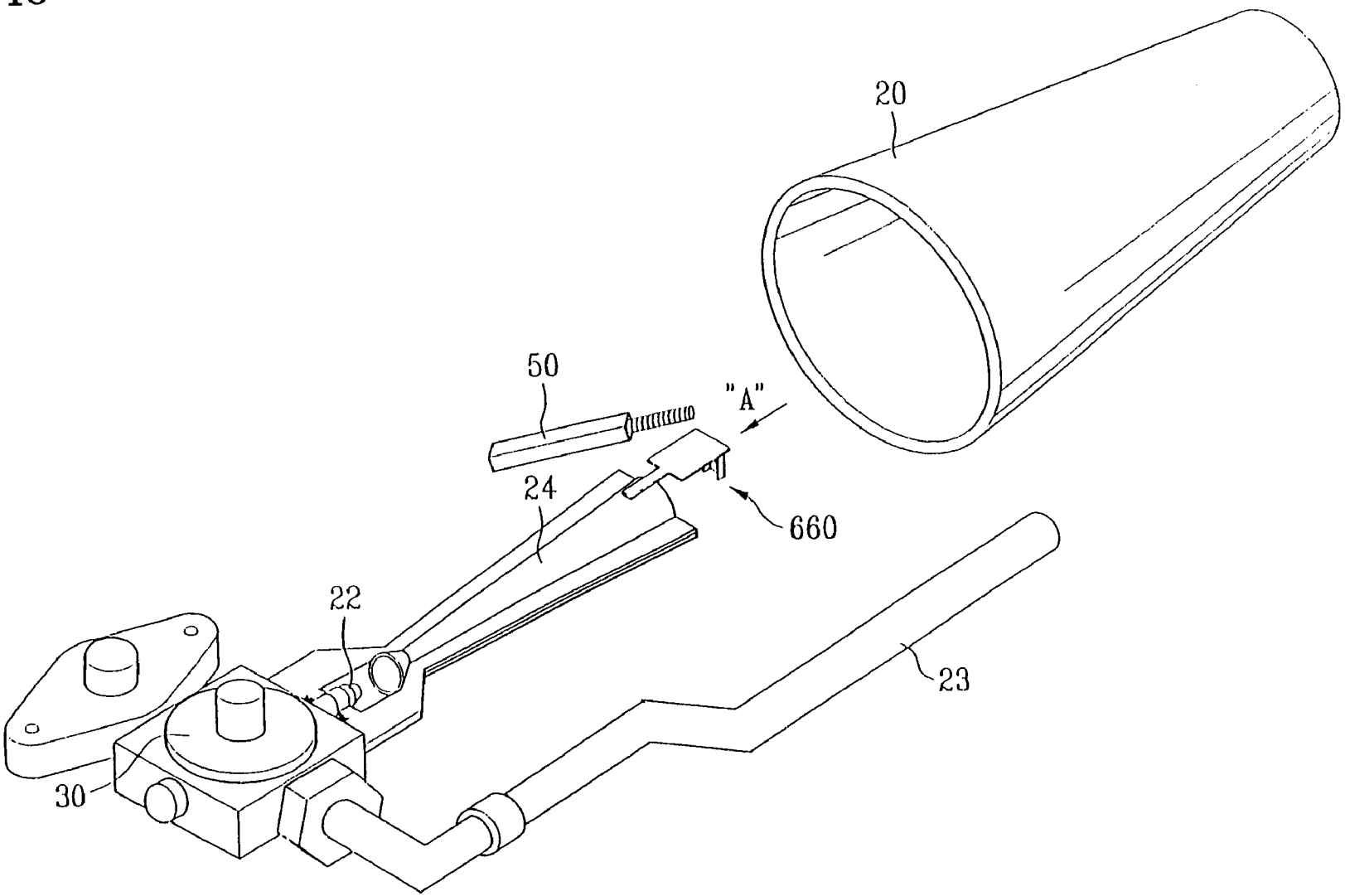
FIG. 16 illustrates a perspective disassembled view of gas burner for a dryer in accordance with an eighth preferred embodiment of the present invention.
Figure 17:
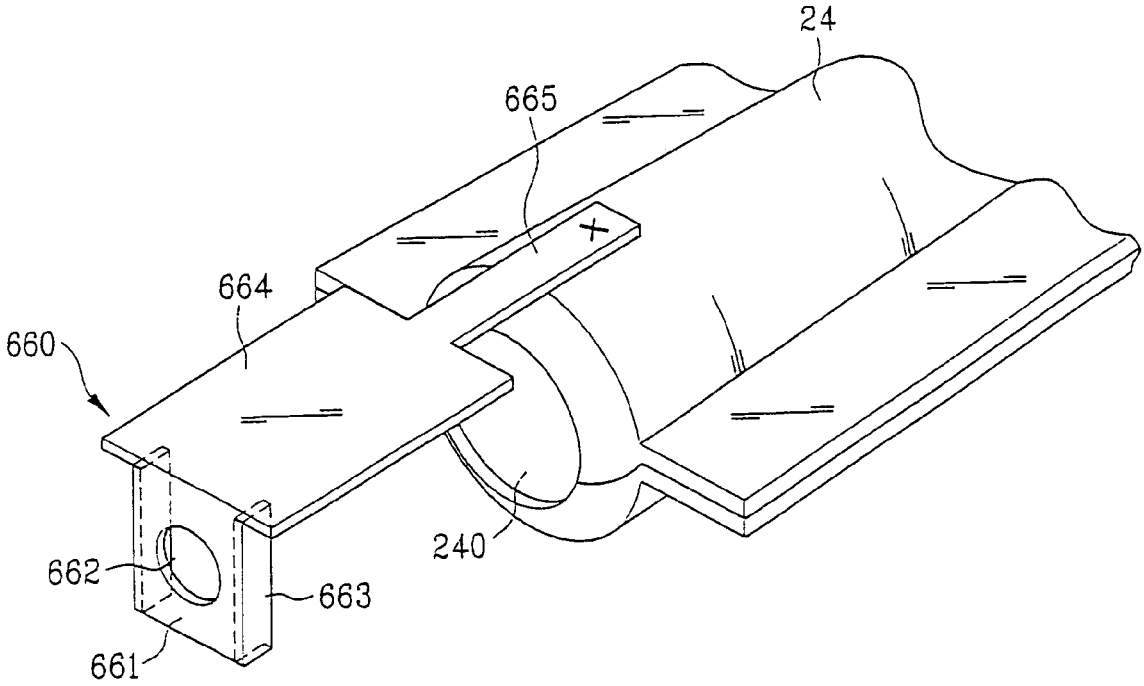
FIG. 17 illustrates a perspective view of an outlet side of a mixing tube seen from 'A' direction in FIG. 16.

FIG. 16 illustrates a perspective disassembled view of a gas burner for a dryer in accordance with an eighth preferred embodiment of the present invention, and FIG. 17 illustrates a perspective view of an outlet side of a mixer seen from 'A' direction in FIG. 16.

Referring to FIGS. 16 and 17, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has section designed such that a flow passage sectional area of the mixing tube 24 becomes the smaller as it goes from an inlet side to an outlet side, and then becomes gradually the larger, again. The gas sprayed from the gas nozzle 22 enters into the inlet of the mixing tube 24, together with the primary air.

There is an igniter 50 at an outlet side of the mixing tube 24 for igniting the gas from the mixing passage 240 of the mixing tube 24, and is either fitted to the mixing tube 24, or supported, separately.

The igniter 50 of ceramic is heated as a current is provided thereto, and ignites the gas mixed, and discharged with the primary air.

There is a flame holder 660 in front of an outlet side of the mixing tube 24. The flame holder 660 includes a vertical face 661 having a central flame hole 662, and sidewall faces 663 at both edges thereof each extended backward to rear of the flame holder 660 to form a width, and a horizontal face 664 extended backward from top of the vertical face 661 perpendicular thereto.

That is, the flame holder 660 has a "]" formed plate structure, and serves for forming the flame divided in four directions, i.e., in directions of the circular flame hole 662 in the vertical face 661, both sides of the vertical face 661, and an underside of the vertical face 661.

The sidewall faces 663 at opposite edges of the vertical face 661 of the flame holder 660 are formed by cutting opposite side parts of an edge where the vertical face 661 and the horizontal face 664 meet, and bending the opposite side parts backward.

The flame holder 660 can be positioned in front of the outlet of the mixing tube 24 spaced a distance away therefrom as the holding part 665 extended from a rear end of the horizontal face 664 is fixed to an outlet side of the mixing tube 24.

It is preferable that an area ratio of the circular flame hole 662 and the vertical face 661, and the like are set by an experiment.

The flame holder 660 serves the gas, mixed with the primary air as the gas passes through the mixing flow passage 240, to be sprayed and burned, wherein the mixed gas (gas mixed with the primary air) is split in directions of the circular flame hole 662 in the central part of the vertical face 661, the underside of the vertical face 661, and outer sides of the sidewall faces 663, and ignited, to form a main flame.

In this instance, in the present invention, an initial ignition capability is enhanced since an amount of the mixed gas colliding onto the vertical face 661 of the flame holder 660 and momentarily staying behind the flame holder 660 before passing through the flame holder 660 is increased while a speed of the mixed gas is dropped.

Moreover, in the present invention, as the main flame is split into a plurality of flames by the flame holder 660 having the vertical face 664 with the central circular flame hole 662 formed therein, with an increased surface area of the flame on the whole, supply of the secondary air to the flame becomes more smooth.

In the meantime, the mixing tube 24 is fitted tilted upward at an angle as it goes from the inlet side to the outlet side, so that a tube axis direction of the mixing tube is in agreement with a direction of flame, naturally.

The operation of the foregoing eighth embodiment of the present invention will be explained, with reference to FIGS. 16, and 17.

For having a drying process progressed in a dryer, it is required to elevate a temperature of air introduced into the drying chamber 5 as the gas is burned. For this, gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., the mixed gas) mixed with the primary air as the gas and the primary air flow along the inside passage of the mixing tube 24 is split, and sprayed through the circular flame hole 662, left and right sides of the horizontal face, and the underside of the horizontal face of the flame holder 660 provided on the outlet side of the mixing tube 24. The mixed gas sprayed thus is ignited as the mixed gas receives heat from the igniter 50 provided adjacent to the flame holder 660.

Then, drying hot air is produced continuously as combustion is made, as the mixed gas is kept sprayed through the circular flame hole 662, left and right sides of the horizontal face, and the underside of the horizontal face of the flame holder 660 in a split state.

According to this, a total flame length becomes shorter, and a contact area of the flame with the secondary air becomes larger.

That is, as the mixed gas discharged through the outlet side of the mixing tube 24 is split in four directions by the horizontal face having the circular flame hole 662 formed therein of the flame holder 660, an entire length of the flame becomes shorter, and more amount of secondary air is introduced to the split short flames, with an increased mixing effect of the flames with the air to enhance combustion, thereby achieving a perfect combustion, with blue flames in a stable flame state.

In other words, as the flame is split into four flames, an entire surface area of the flames is increased, with a relatively increased contact area with ambient air, i.e., the secondary air, the combustion of gas is made more effectively, to achieve the perfect combustion.

Moreover, the flame holder 660 divides between an inside and an outside of the mixing tube 24, to prevent a reverse direction flame, and to prevent the flame from becoming unstable by an external influence.

Thus, as the flame is shortened, and the combustion is made effectively to achieve perfect combustion, the present invention can prevent the lifting in which an ignition point of the flame is positioned far from an outlet of the mixing tube 24, and the overheating of the air to be supplied to the drying chamber 5 in advance.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

Lastly, a gas burner for a dryer in accordance with a ninth preferred embodiment of the present invention will be explained, with reference to the attached drawings. Alikely, parts identical to the related art will be given the same reference symbols.

Figure 18:
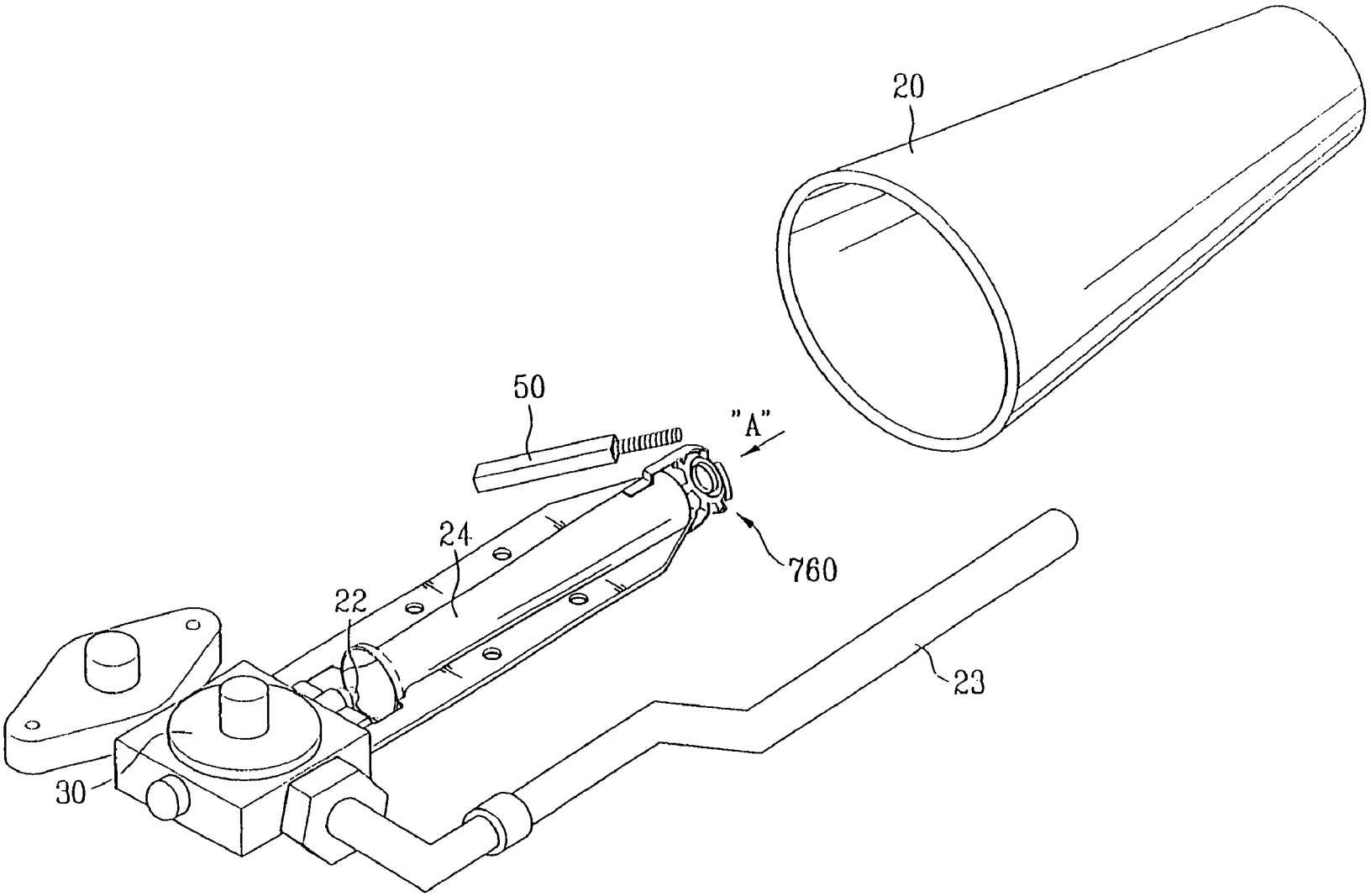
FIG. 18 illustrates a perspective disassembled view of gas burner for a dryer in accordance with a ninth preferred embodiment of the present invention.
Figure 19:
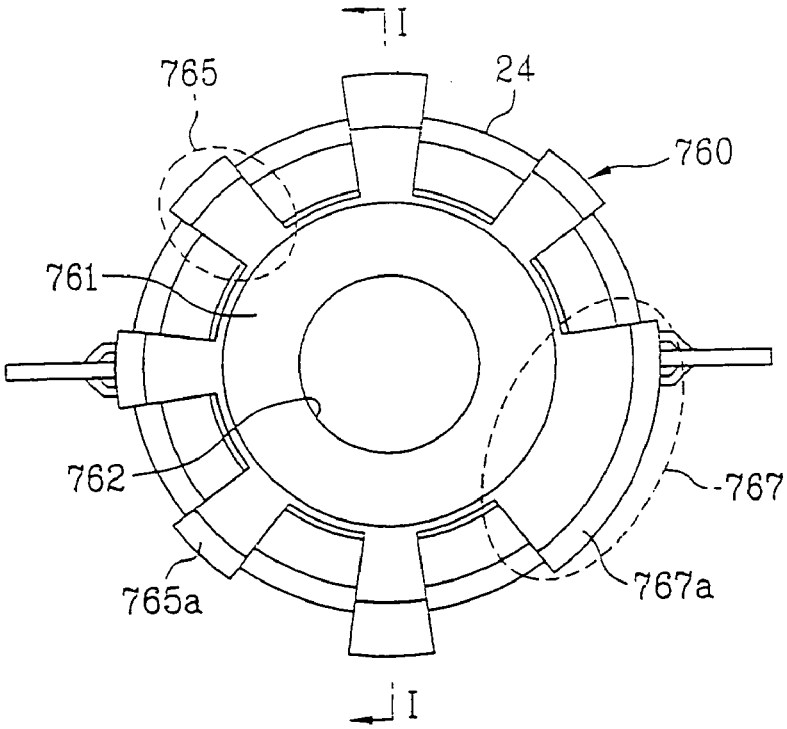
FIG. 19 illustrates a front view of an outlet side of a mixer seen from 'A' direction in FIG. 18.
Figure 20:
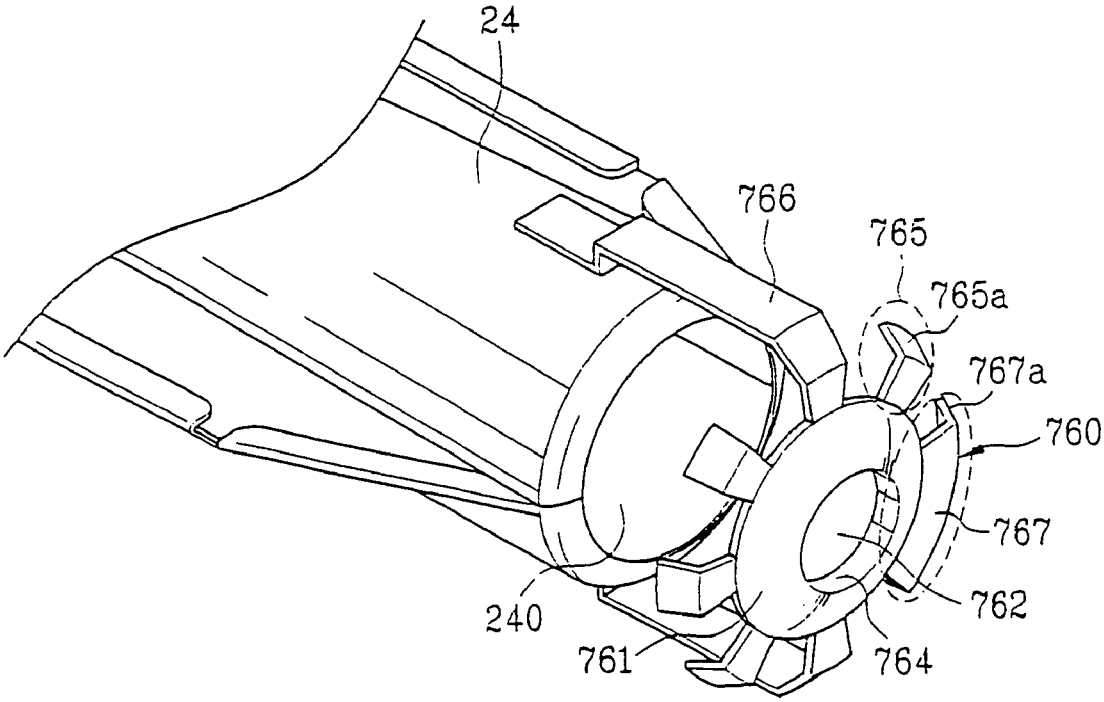
FIG. 20 illustrates a perspective view of an outlet side of a mixing tube seen from 'A' direction in FIG. 18.

FIG. 18 illustrates a perspective disassembled view of a gas burner for a dryer in accordance with a ninth preferred embodiment of the present invention, FIG. 19 illustrates a front view of an outlet side of a mixer seen from 'A' direction in FIG. 18, and FIG. 20 illustrates a perspective view of an outlet side of a mixer seen from 'A' direction in FIG. 18.

Figure 21:
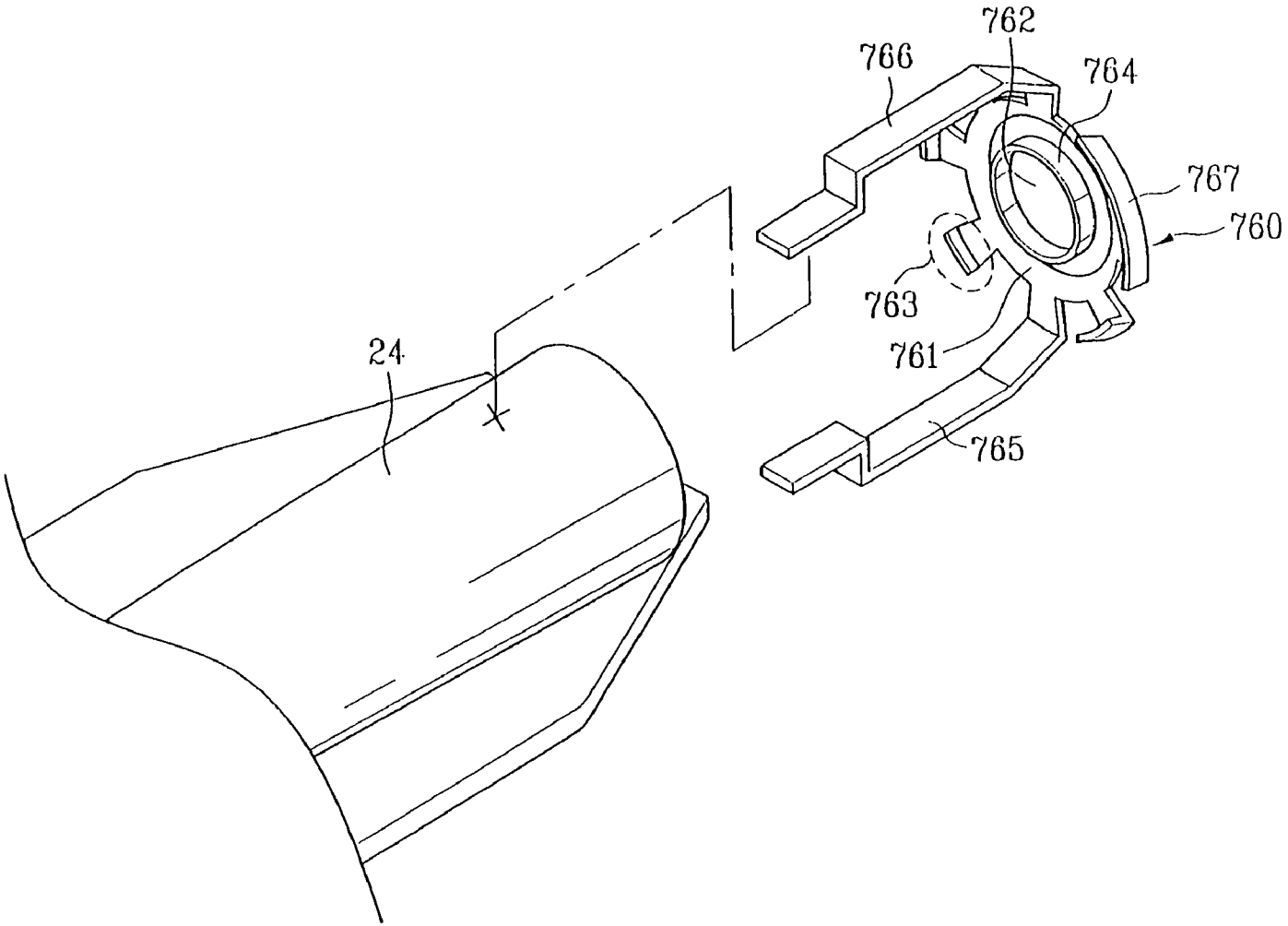
FIG. 21 illustrates a perspective, disassembled, back side view of FIG. 20.
Figure 22:
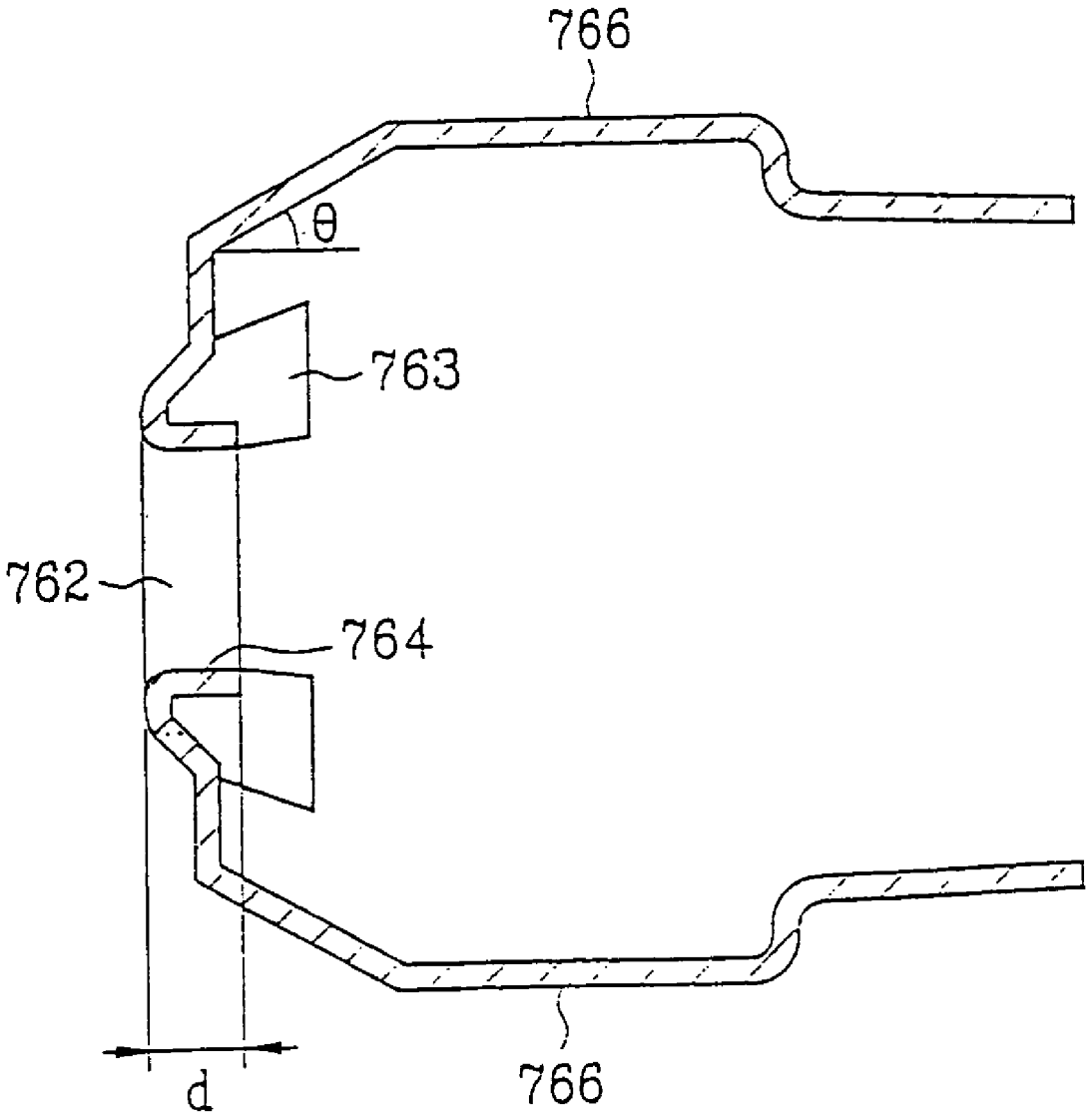
FIG. 22 illustrates a section of a flame holder across a line I—I in FIG. 19.

FIG. 21 illustrates a perspective, disassembled, back side view of FIG. 20, and FIG. 22 illustrates a section of a flame holder across a line I—I in FIG. 19.

Referring to FIGS. 18–22, there is a gas tube 32 connected to a gas nozzle 30 which sprays gas for combustion. The gas nozzle 22 has a valve 30 fitted thereto for controlling spray of gas received through the gas tube 32, and a spray amount of the spray when the gas is sprayed.

There is a mixing tube 24 in front of the gas nozzle 22. The mixing tube 24 has a mixing passage 240 therein for mixing the gas from the gas nozzle 22 and primary air. The mixing tube 24 has section designed such that a flow passage sectional area of the mixing tube 24 becomes the smaller as it goes from an inlet side to an outlet side, and then becomes gradually the larger, again. The gas sprayed from the gas nozzle 22 enters into the inlet of the mixing tube 24, together with the primary air.

There is an igniter 50 at an outlet side of the mixing tube 24 for igniting the gas from the mixing passage 240 of the mixing tube 24, and is either fitted to the mixing tube 24, or supported, separately.

The igniter 50 of ceramic is heated as a current is provided thereto, and ignites the gas mixed, and discharged with the primary air.

There is a flame holder 760 in front of an outlet side of the mixing tube 24. The flame holder 760 includes an annular hub 761 having a central circular flame hole 762, and a plurality of blades 765, and 767 fitted to an outer circumference of the hub 761 at fixed intervals along a circumferential direction thereof for splitting the flame.

Each of the blades 765, and 767 has a backward bent part 765*a*, or 767*a*, and one 767 of the blades has an arc longer by more than two times of the other blades 765.

The annular hub 761 is convexed forward.

The backward bent part 765*a*, or 767*a* is sloped at an angle θ in a range of 10–30 degrees with respect to an axis passing through the circular flame hole 762 of the hub 761.

The flame holder 760 can be positioned in front of the outlet of the mixing tube 24 as the holding part 766 extended from one side of the hub 761 is fixed to an outlet side of the mixing tube 24.

It is preferable that a diameter of the circular flame hole 762, areas of the blades 765 and 767, and the like are set by an experiment.

In the meantime, the flame holder 760 serves the gas, mixed with the primary air as the gas passes through the mixing flow passage 240, to be sprayed and burned, wherein the main flame is formed by the mixed gas (gas mixed with the primary air) sprayed through the circular flame hole 762 in the central part of the hub 761, and openings between the blades 765, and 767.

That is, in the present invention, as the main flame is split into a plurality of flames by the circular flame hole 762, and the blades 765, and 767, with an increased surface area of the flame on the whole, supply of the secondary air to the flame becomes smooth.

Especially, in the embodiment, of the blades formed along the circumferential direction of the hub 761 of the flame holder 760, since one of the blade 767 has an arc length longer than other blades 765 by more than two times, with a larger blade area, and there are the backward bent parts 765*a* and 767*a* at fore ends of the blades 765 and 767, increasing an amount of the mixed gas momentarily staying behind the flame holder 760 before passing through the flame holder 760 while dropping a speed of the mixed gas, an initial ignition capability is enhanced, making the ignition easy. That is, the flame holder 760 of the present invention improves an initial ignition characteristic.

In the meantime, the mixing tube 24 is fitted tilted upward at an angle as it goes from the inlet side to the outlet side, so that a tube axis direction of the mixing tube is in agreement with a direction of flame, naturally.

The operation of the foregoing eighth embodiment of the present invention will be explained, with reference to FIGS. 18 to 22.

For having a drying process progressed in a dryer, it is required to elevate a temperature of air introduced into the drying chamber 5 as the gas is burned. For this, gas is sprayed into the mixing tube 24 through the gas nozzle 22.

Along with the gas, primary air is introduced into the mixing tube 24. Accordingly, the gas and the primary air are mixed, and flow along the passage inside of the mixing tube 24.

Then, the gas (i.e., the mixed gas) mixed with the primary air as the gas and the primary air flow along the inside passage of the mixing tube 24 is split, and sprayed through the circular flame hole 762, and openings between the blades 765 and 767 of the flame holder 760 provided on the outlet side of the mixing tube 24. The mixed gas sprayed thus is ignited as the mixed gas receives heat from the igniter 50 provided adjacent to the flame holder 760.

Then, drying hot air is produced continuously as combustion is made, as the mixed gas is kept sprayed in a split state by the circular flame hole 762, and the blades 765 and 767 of the flame holder 760.

According to this, a total flame length becomes shorter, and a contact area of the flame with the secondary air becomes larger.

That is, as the mixed gas discharged through the outlet side of the mixing tube 24 is sprayed, with the flame split by the circular flame hole 662, and the blades 765, and 767 of the flame holder 760, an entire length of the flame becomes shorter, and more amount of secondary air is introduced to the split short flames, with an increased mixing effect of the flames with the air to enhance combustion, thereby achieving a perfect combustion, with blue flames in a stable flame state.

In other words, as the flame is split into a plurality of flames, an entire surface area of the flames is increased, with a relatively increased contact area with ambient air, i.e., the secondary air, the combustion of gas is made more effectively, to achieve the perfect combustion.

Moreover, the flame holder 760 divides between an inside and an outside of the mixing tube 24, to prevent a reverse direction flame, and to prevent the flame from becoming unstable by an external influence.

Especially, since there is a boss with a length 'd' in an inner side of the hub 761 extended to a rear side of the flame holder 760, reversing of flame is delayed, to prevent the reversing of the flame at the end.

Thus, as the flame is shortened, and the combustion is made effectively to achieve perfect combustion, the present invention can prevent the lifting in which an ignition point of the flame is positioned far from an outlet of the mixing tube 24, and the overheating of the air to be supplied to the drying chamber 5 in advance.

Meanwhile, in the drying process again, the external air introduced into an inside of the guide funnel 20 is heated, and turned into heated air as the gas is burned thus, and introduced into the drying chamber 5 through the hot air supply duct 12.

The hot air introduced into the drying chamber 5 inside of the drum 1 absorbs moist contained in laundry, passes through the lint filter 14 again, and is blown toward the discharge pipe 19 by the blower 17 through the lint duct 15.

In the meantime, the flame holder 760 may be rotatably fitted to an inside of the outlet side of the mixing tube 24. That is, the flame holder 760 may be provided with an additional driving source (not shown) for continuous rotation during operation, so that the gas sprayed through the flame holder 360 forms turbulence.

INDUSTRIAL APPLICABILITY

As has been explained, the gas burner for a dryer in accordance with anyone of the preferred embodiments of the present invention is designed to split a flame into many flames by means of the flame holder provided to an outlet side of the mixing tube. Accordingly, a length of the flame can be made shorter, that prevents lifting of the flame, and entrance of the flame into an inside of the drum.

Moreover, the enlarged contact area of the flame with the secondary air coming from the split of the flame increases an amount of air introduced into the flame, that enhances a mixing effect of the flame with the secondary air, to achieve perfect combustion, that reduces production of hazardous gas, and stabilizes flame.

Along with this, the flame holder prevents a combustion state in either one of front/rear parts of the flame holder being transferred to the other side, preventing reversing of fire, thereby helping stabilization of the flame.

Accordingly, the present invention is very useful for industry.

What is claimed is:

1. A gas burner for a dryer comprising:

a gas nozzle for receiving and spraying a gas;

a mixing tube for mixing the gas sprayed from the gas nozzle and primary air;

an igniter fitted to an outlet side of the mixing tube for igniting the gas mixed with the primary air passed through the outlet of the mixing tube; and a flame holder at an outlet side of the mixing tube for splitting the gas mixed with the primary air and spraying the gas mixed with the primary air, wherein the flame holder includes a central hole and a first plurality of holes disposed at a periphery of the flame holder with a plurality of elongated apertures located between the central hole and the first plurality of holes, wherein the flame holder further includes a second plurality of circular flame holes between the elongated apertures in a radial direction at fixed intervals to be concentric with respect to the central hole.

2. A gas burner as claimed in claim 1, wherein the second plurality of circular flame holes have the same diameters.

3. A gas burner as claimed in claim 1, wherein the elongated apertures are slit forms of flame holes arranged in a radial direction in a surface of the flame holder; and the first plurality of boles are rectangular.

4. A gas burner as claimed in claim 1, wherein the second plurality of circular flame holes between the central circular flame hole of the flame holder and the elongagted apertures have the same diameters.

5. A gas burner as claimed in claim 1, wherein the central hole and the first plurality of holes have different diameters.

6. A gas burner as claimed in claim 1, wherein the mixing tube has a venturi structure, and includes an enlarged part an outlet of the mixing tube wherein the flame holder is fitted to an inside of the enlarged part.

7. A gas burner as claimed in claim 6, wherein the enlarged part at the outlet of the mixing tube is formed as one unit with the mixing tube, or as a detachable separate piece.

8. A gas burner as claimed in claim 1, wherein the flame holder is fitted so as to be located in front of an outlet of the mixing tube as a holding part extended from a side of the mixing tube.

* * * * *